US007131828B2

(12) United States Patent
Watanabe et al.

(10) Patent No.: US 7,131,828 B2
(45) Date of Patent: Nov. 7, 2006

(54) COATING DEVICE FOR POWDER MATERIAL

(75) Inventors: Yasushi Watanabe, Shizuoka (JP); Kiyoshi Morimoto, Shizuoka (JP); Yuji Iwase, Shizuoka (JP); Satoru Hiruta, Shizuoka (JP)

(73) Assignee: Kyowa Hakko Kogyo Co., Ltd., Tokyo (JP)

( * ) Notice: Subject to any disclaimer, the term of this patent is extended or adjusted under 35 U.S.C. 154(b) by 153 days.

(21) Appl. No.: 10/257,068

(22) PCT Filed: Apr. 12, 2001

(86) PCT No.: PCT/JP01/03142

§ 371 (c)(1),
(2), (4) Date: Feb. 10, 2003

(87) PCT Pub. No.: WO01/76860

PCT Pub. Date: Oct. 18, 2001

(65) Prior Publication Data

US 2004/0083872 A1 May 6, 2004

(30) Foreign Application Priority Data

Apr. 12, 2000 (JP) ..... 2000-111350

(51) Int. Cl.
*B29C 33/60* (2006.01)
*B29C 43/28* (2006.01)

(52) U.S. Cl. ..... 425/100; 425/103; 425/107; 425/217; 425/345

(58) Field of Classification Search ..... 425/90, 425/100, 103, 107, 215, 218, 345
See application file for complete search history.

(56) References Cited

U.S. PATENT DOCUMENTS

| | | | | |
|---|---|---|---|---|
| 3,799,716 | A * | 3/1974 | Salts | 425/104 |
| 5,407,339 | A * | 4/1995 | Fehlhafer | 425/100 |
| 5,643,630 | A * | 7/1997 | Hinzpeter et al. | 425/345 |
| 5,700,492 | A * | 12/1997 | Morimoto et al. | 425/100 |
| 6,036,974 | A * | 3/2000 | Tsushima et al. | 424/464 |
| 6,432,534 | B1 * | 8/2002 | Hayakawa et al. | 264/309 |

FOREIGN PATENT DOCUMENTS

| | | |
|---|---|---|
| EP | 1 222 917 | 7/2002 |
| EP | 1 260 220 | 11/2002 |

(Continued)

*Primary Examiner*—Yogendra N. Gupta
*Assistant Examiner*—Thu Khanh T. Nguyen
(74) *Attorney, Agent, or Firm*—Fitzpatrick, Cella, Harper & Scinto

(57) ABSTRACT

A powder material application apparatus capable of applying powder material uniformly onto lower surfaces of plural upper punches, upper surfaces of plural lower punches and inner circumferences of plural dies of a tabletting machine. Powder material is applied on a material contacting surface of the lower punch by spraying powder material mixed with air from a powder material spray port for lower punch of a powder material application part for lower punch. Powder material is applied on a material contacting surface of the upper punch wherein powder material is not applied enough according to gravity by spraying powder material mixed with air from a powder material spray port for upper punch while the upper punch moves from an initial end to a terminal end of the powder material spray port for upper punch. The powder material spray port for upper punch is provided along the rotary orbit of the upper punches and is elongated more than the powder material spray port for lower punch.

13 Claims, 15 Drawing Sheets

FOREIGN PATENT DOCUMENTS

| | | |
|---|---|---|
| JP | 59-205970 | 11/1984 |
| JP | 11-169437 | 6/1999 |
| WO | WO 01/26632 | 4/2001 |
| WO | WO 01/52820 | 7/2001 |

* cited by examiner

COATING DEVICE FOR POWDER MATERIAL

TECHNICAL FIELD

The present invention relates to a powder material application apparatus which can uniformly apply powder material, more particularly lubricant, on the material contacting surfaces of plural dies, plural upper punches and plural lower punches.

BACKGROUND ART

An external lubrication type tabletting machine has been already developed as a technique for preventing punches and dies of a rotary type tabletting machine from grinding and for eliminating tabletting problems such as sticking, lamination and capping on produced tablets.

FIG. 15 is a sectional view diagrammatically showing one embodiment of a conventional powder material application apparatus used for such an external lubrication type tabletting machine.

The powder material application apparatus 101 is provided between a tablet discharge position and a molding material charging position of a rotary type tabletting machine above a turntable 112.

The powder material application apparatus 101 has a nozzle means 101*a* and a suction nozzle means 101*b* provided next to the nozzle means 101*a*.

The nozzle means 110*a* has a powder material spray port for lower punch h101 and a powder material spray port for upper punch h102.

For the nozzle means 101*a*, lubricant powder mixed with air is supplied.

The suction nozzle means 101*b* has a powder material suction port for lower punch h103 and a powder material suction port for upper punch h104.

An air suction means such as a blower (not shown) is connected to the nozzle suction means 101*b*. Upon driving the air suction means (not shown), suction mode air flow toward the powder material suction port for lower punch h103 is generated around the suction port h103 and suction mode air flow toward the powder material suction port for upper punch h104 is generated around the suction port h104.

Next, a method for sequentially applying lubricant on each material contacting surface (each inner circumferential wall of die 13 . . . ) of plural dies 113 . . . provided on a turntable 112 of a rotary type tabletting machine, on each material contacting surface (each upper surface of lower punch 114 . . .) S114 . . . of plural lower punches 114 . . . inserted in a predetermined position in each one of plural dies 113 . . . and on each material contacting surface (each lower surface of upper punch 115 . . . ) S115 . . . of plural upper punches 115 . . . by means of the powder material application apparatus 101.

The rotary type tabletting machine is driven to rotate the turntable 112, plural lower punches 114 . . . and plural upper punches 115 . . . at a fixed rotary speed.

Lubricant powder mixed with air is supplied to the nozzle means 110*a*.

Thus supplying lubricant, lubricant powder mixed with air is sprayed from each one of powder material spray port for lower punch h101 and powder material spray port for upper punch h102.

Lubricant powder mixed with air is sprayed in the die 113 passing under the powder material spray port for lower punch h101 and on the material contacting surfaces S113 of the die 113, S114 of the lower punch 114 inserted into a predetermined position in the die 113, thereby applying lubricant powders thereon. Further, lubricant powder mixed with air is sprayed on the material contacting surface S115 of the upper punch 115 passing above the powder material spray port for upper punch h102, thereby applying lubricant powders thereon.

The air suction means (not shown) connected to the suction nozzle means 101*b* is driven.

Upon driving the suction means (not shown), a suction mode air flow toward the powder material suction port for lower punch h103 is generated around the suction port h103 and a suction mode air flow toward the powder material suction port for upper punch h104 is generated around the suction port h104.

Thus, air flow toward the powder material suction port for lower punch h103 from the powder material spray port for lower punch h101 is generated therebetween and air flow toward the powder material suction port for upper punch h104 from the powder material spray port for upper punch h102 is generated therebetween.

As a result, extra lubricant powder which is mixed with air and sprayed from the powder material spray port for lower punch h101 into the die 112 passing under the spray port h101 doesn't reach the die 113 and the lower punch 114 and suspends between the powder material spray port for lower punch h101, the die 112 and the lower punch 114 is removed by the air directing from the spray port h101 to the suction port for lower punch h103. Further, extra lubricant powder which is sprayed from the spray port h102 on the upper punch 124 passing above the spray port h102 doesn't reach the material contacting surface S115 of the upper punch 115 and suspends between the spray port h102 and the upper punch 115 is removed by the air directing from the spray port h101 to the suction port h103.

When lubricant is thus sequentially applied on each material contacting surface S113 . . . of plural dies 113 . . . provided on the turntable 112 of the rotary type tabletting machine, each material contacting surface S114 . . . of plural lower punches inserted in a fixed position in each one of the plural dies 113 . . . , each material contacting surface S115 . . . of the plural upper punches 115 . . . by means of the powder material application apparatus 101, extra lubricant powder isn't applied on each material contacting surface S113 . . . of the die 113 . . . , each material contacting surface S114 of the lower punches 114 . . . and each material contacting surface S115 . . . of the upper punches 115 . . . . In addition, members of the rotary type tabletting machine other than those used for applying lubricant powder aren't contaminated with lubricant powder.

Therefore, lubricant is sequentially applied on each material contacting surface S113 . . . of plural dies 113 . . . provided on the turntable 112 of the rotary type tabletting machine, each material contacting surface S114 . . . of plural lower punches inserted in a fixed position in each one of the plural dies 113 . . . , each material contacting surface S115 . . . of the plural upper punches 115 . . . by means of the powder material application apparatus 101, members of the rotary type tabletting machine other than those used for applying lubricant powder aren't contaminated with lubricant powder and lubricant powders can be uniformly applied on each material contacting surface S113 . . . of plural dies 113 . . . , and each material contacting surface S114 . . . of plural lower punches inserted in a fixed position in the plural dies 113 . . . , each material contacting surface S115 of the plural upper punches 115 . . . . As a result, at a material charge position of the rotary type tabletting machine, molding material is charged in a space formed by the die 113 on which material contacting surface S113 lubricant powder is applied and the lower punch 114 on which material contacting surface S114 lubricant powder is applied. Then, at a material compression position of the rotary type tabletting machine, the molding material is compressed by means of the die 113 with the lubricated material contacting surface S113, the lower punch 114 with the lubricated material contacting surface S114 and the upper punch 115 with the lubricated material contacting surface S115. Then tablets which don't include lubricant can be produced without causing tabletting problems such as grinding of the punches and dies, sticking, lamination and capping.

However, according to the powder material application apparatus 101, because application of lubricant powder on the material contacting surface S114 of the lower punch 114 and the material contacting surface S115 of the upper punch 115 are executed under similar conditions as shown in FIG. 15, application of lubricant powder on the material contacting surface S115 of the upper punch 115 which is hard because gravity hasn't been carried out successfully.

DISCLOSURE OF THE INVENTION

The present invention has been proposed to solve the above-mentioned problems. The object of the present invention is to provide a powder material application apparatus capable of adequately applying lubricant powder on a material contacting surface of an upper punch on which lubricant powder has not applied enough because of gravity.

The inventors of the present invention have conducted research and development for a long time of powder material application apparatus which can apply lubricant powder on the material contacting surface of the upper punch on which lubricant isn't easily applied by gravity. And they have found lubricant powder may be sufficiently applied on the material contacting surface of the upper punch if lubricant powder is exposed longer than on the material contacting surface of the lower punch on which extra lubricant powder is easily applied by gravity.

Further, they have found the application amount of lubricant powder on the material contacting surface of the lower punch on which extra lubricant is easily applied by gravity and the application amount of lubricant powder on the material contacting surface of the upper punch on which lubricant has not being applied enough because of gravity might be the same or substantially the same if extra lubricant powder is blown off from the material contacting surface of the lower punch and thus blown lubricant powder is applied on the material contacting surface of the upper punch. Thereafter, molding material is charged in a space formed by the die on which material contacting surface lubricant powder is applied and the lower punch on which material contacting surface lubricant powder is applied at a material charge position of the rotary type tabletting machine. Then, the molding material is compressed by means of the die with the material contacting surface lubricated, the lower punch with the material contacting surface lubricated and the upper punch with the material contacting surface lubricated at the material compression position of the rotary tabletting machine. Finally they have found tablets which don't include lubricant can be produced without causing grinding of the punches and dies, tabletting problems such as sticking, lamination and capping.

Furthermore, they have found uniform application of lubricant powder on each material contacting surface of plural dies, each material contacting surface of plural lower punches and each material contacting surface of plural upper punches can be effectively executed depending on the positions of a material supply port and a first communication passage, the size and shape of the powder material spray port for lower punch, the size and shape of the powder material spray port for upper punch, the diameter of a second communication passage introducing powder material from the powder material application part for lower punch to the powder material application part for upper punch, and the relation of the distance between the powder material application apparatus for upper punch and the material contacting surface of the upper punch passing above the powder material application part for upper punch and the material contacting surface of upper punch. In addition, they have found from experiments that application of lubricant powder on the members other than each material contacting surface of the plural dies, each material contacting surface of plural lower punches and each material contacting surface of plural upper punches is prevented and they have completed the present invention by hard effort.

According to the powder material application apparatus of the present invention wherein powder material is sequentially applied onto material contacting surfaces of plural dies provided on a turntable of a rotary type tabletting machine, onto material contacting surfaces of plural upper punches rotating in synchronism with the plural dies and onto material contacting surfaces of plural lower punches rotating in synchronism with the plural dies, the powder material application apparatus comprises a powder material application part for lower punch and a powder material application part for upper punch. The powder material application part for lower punch comprises a powder material supply port for supplying powder material mixed with air, the powder material supply port being provided on the upper surface of the powder material application part for lower punch; a powder material spray port for lower punch for spraying powder material mixed with air supplied from the powder material supply port onto each material contacting surface of the plural dies and onto each material contacting surface of the lower punch inserted in a predetermined position in each one of plural dies, the powder material spray port for lower punch being provided on the lower surface of the powder material application part for lower punch so as to be connected to the powder material supply port via a first communication passage and the dies passing under the lower part of the powder material supply port for lower punch when the rotary type tabletting machine is driven; and a pedestal to which a powder material application part for upper punch is connected, the pedestal comprising a hollow part connected to the powder material spray port for lower punch via a second communication passage and an opening provided above the hollow part along a rotary orbit of the plural dies. The powder material application part for upper punch is provided on the pedestal of the powder material spray part for lower punch and has a powder material spray port for upper punch, the powder material spray port for upper punch being communicated with the opening of the powder material application part for lower punch and being elongated more than the powder material spray port for lower punch along the rotary orbit of the plural upper punches passing above the upper surface of the powder material application part for upper punch when the rotary type tabletting machine is driven.

The powder material application apparatus is characterized in that powder material isn't simultaneously applied on the lower punch and its corresponding upper punch.

The powder material spray port for upper punch is provided longer along the orbit of the plural upper punches comparing with the powder material spray port for lower punch of the powder material application part for lower punch so that plural upper punches on which material contacting surface powder material isn't easily applied by gravity are exposed to the powder material mixed with air sprayed from the powder material spray port for upper punch for a long time while each one of plural upper punches is moved from an initial end to the terminal end of the powder material spray port for upper punch.

As a result, required amount of powder material can be uniformly applied on each material contacting surface of plural upper punches on which powder material has not applied enough because of gravity.

In addition, according to the powder material application apparatus, powder material sprayed from the powder material spray port for lower punch via the first communication passage is supplied into the powder material spray port for upper punch.

Thus, powder material which is apt to be accumulated on the material contacting surface of the lower punch on which powder material is easily applied by gravity can be blown off into the powder material spray port for upper punch.

If the powder material application apparatus uses lubricant powder as powder material, extra lubricant powder is blown out of the material contacting surface of the lower punch on which extra lubricant powder is easily applied by gravity. The blown out lubricant powder from the material contacting surface of the lower punch is applied on the material contacting surface of the upper punch on which lubricant powder is hardly applied by gravity. Thus the application amount of lubricant powder on the material contacting surface of the lower punch on which lubricant powder is easily applied by gravity and the application amount of lubricant powder on the material contacting surface of the upper punch on which lubricant powder is hardly applied by gravity can be the same or substantially same.

Therefore, when lubricant is sequentially applied on each material contacting surface of plural dies provided on the turntable of the rotary tabletting machine, each material contacting surface of plural lower punches inserted in a fixed position in each one of plural dies, and each material contacting surface of plural upper punches, lubricant powder is uniformly applied on each material contacting surface of dies, upper punches and lower punches. Then molding material is charged in the cavity formed by the die on which material contacting surface lubricant powder is applied and the lower punch which is inserted in the die and on which material contacting surface is applied with lubricant powder at the material charge position. The charged molding material is compressed with the lubricated die, the lubricated lower punch and the lubricated upper punch at the material compression position, thereby producing tablets without including lubricant, without causing grinding of the punches and dies of the rotary type tabletting machine and without causing sticking, lamination, capping and so on.

According to the powder material application apparatus of the present invention, a connecting direction of the powder material supply port and the first communication passage is substantially liner.

In this powder material application apparatus, the powder material supply port and the first communication passage of the powder material application apparatus are connected in liner direction so that powder material can be supplied to the spray port for lower punch while being preferably dispersed.

According to the powder material application apparatus of the present invention, the pipe diameter of the powder material spray port for lower punch is different from the pipe diameter of the first communication passage.

Because of the difference of the pipe diameter of the powder material spray port for lower punch and that of the first communication passage, the application amount of powder material on the material contacting surface of the lower punch is easily controlled.

Therefore, using this powder material application apparatus, the application of lubricant material on the material contacting surface of the lower punch is easily controlled to be most suitable.

According to the powder material application apparatus of the present invention, a connecting form of the powder material spray port for lower punch and the first communication passage is like an elbow.

The connected part of the powder material spray port for lower punch and the first communication passage is formed like an elbow, thereby supplying powder material mixed with air into the powder material spray port for lower punch without causing accumulation in the connected part.

According to the powder material application apparatus of the present invention, the powder material spray port for lower punch is detachable from the first communication passage.

The powder material spray port for lower punch of the powder material application apparatus is designed to be detachable to the first communication passage so that the application amount of powder material on the material contacting surface of the lower punch can be easily controlled by optionally changing the shape of the powder material spray port for lower punch.

According to the powder material application apparatus of the present invention, the powder material spray port for lower punch is formed like a ring.

The powder material spray port for lower punch of the powder material application apparatus is formed like a ring so that the application amount of powder material on the material contacting surface of the lower punch can be easily controlled by changing the sectional area of the ring-like spray port.

Therefore, according to the powder material application apparatus of the present invention, the amount of lubricant powder is easily controlled to be suitably applied on the material contacting surface of the lower punch.

According to the powder material application apparatus of the present invention, the pipe diameter of a second communication passage is smaller than the pipe diameter of the powder material spray port for lower punch and than the section of the hollow part.

The pipe diameter of the second communication passage which introduces powder material from the powder material application part for lower punch to the powder material application part for upper punch is designed to be smaller than that of the powder material spray port for lower punch and the sectional area of the hollow part, therefore, powder material mixed with air flows in the second communication passage faster than in the powder material spray port for lower punch. As a result, powder material mixed with air is transferred to the hollow part from the first communication passage without causing accumulation in the second communication passage.

As a result, the powder material application apparatus doesn't incur waste.

According to the powder material application apparatus of the present invention, a surface treatment for lowering friction resistance was performed on the inside of the powder material spray port for lower punch.

The inside of the powder material spray port for lower punch is rendered with a surface treatment for lowering friction resistance, thereby reducing the friction resistance caused by the powder material supplied from the first communication passage and the inside of the powder material spray port for lower punch. As a result, powder material is transferred without causing further accumulation and attachment so as not to incur waste of powder material.

According to the powder material application apparatus of the present invention, the powder material spray port for upper punch of the powder material application part for upper punch has a length larger than the width.

The powder material spray port for upper punch of the powder material application part for upper punch is formed longer in a direction along the rotary orbit of the upper punches and is formed shorter in a direction of the width orthogonal to the rotary orbit of the upper punches so that powder material sprayed together with air from the powder material spray port for upper punch is hardly scattered in the area other than the material contacting surface of the upper punch.

Therefore, applying this powder material application apparatus, the members of the rotary type tabletting machine which should not be applied with powder material aren't polluted by the material.

In addition, tablets without including lubricant powder can be effectively produced by the powder material application apparatus.

According to the powder material application apparatus of the present invention, plural slit apertures are provided along the rotary orbit of the plural upper punches, the slit aperture being provided at right angle to the rotary orbit of the plural upper punches passing above the material spray port for upper punch of the powder material application part for upper punch when the rotary type tabletting machine is driven.

The powder material spray port for upper punch of the powder material application apparatus is constructed such that plural slit apertures, each provided in orthogonal direction to the rotary orbit of plural upper punches, are aligned along the rotary orbit of the upper punch.

Therefore, powder material mixed with air which is sprayed from each one of slit apertures provided in orthogonal direction to the rotary orbit of the upper punches is rectified by the slit apertures to flow upward from the powder material spray port for upper punch. Accordingly powder material mixed with air and supplied from each slit aperture collides with the material contacting surface of the upper punch in substantially orthogonal direction.

As a result, powder material is surely applied on the material contacting surface of the upper punch on which powder material is hardly applied by gravity.

According to the powder material application apparatus of the present invention, the width of the powder material spray port for upper punch of the powder material application part for upper punch and the distance between the upper surface of the powder material application part for upper punch and the material contacting surface of the plural upper punches passing above the upper surface of the powder material application part for upper punch while driving the rotary type tabletting machine satisfy the following equation;

$$L=W\times\alpha$$

L=distance between the upper surface of powder material application part for upper punch and the material contacting surface of plural upper punches passing above the powder material application part for upper punch;

W=width of the powder material spray port for upper punch of the powder material application part for upper punch $\alpha$=constant more than or equal to 1 and less than or equal to 30.

It is preferable $\alpha$ is more than or equal to 1 and less than or equal to 8, more preferably more than or equal to 1 and less than or equal to 6.

The distance between the upper surface of the powder material application part for upper punch and the material contacting surface of the upper punches passing above the upper surface upon driving the rotary type tabletting machine and the width of the material spray port for upper punch of the powder material application part for upper punch are defined so as to prevent powder material mixed with air and sprayed from the powder material spray port for upper punch from scattering into the area other than the material contacting surface of the upper punch.

Therefore, according to this powder material spray means, the members of the rotary type tabletting machine on which powder material should not be applied don't become dirty.

If the powder material application apparatus uses lubricant powder as powder material, tablets without including lubricant powder can be effectively produced.

According to the powder material application apparatus of the present invention, an air suction means having an air suction port is further provided so as to entirely cover the powder material spray port for upper punch and is provided above the powder material spray port for upper punch of the powder material application part for upper punch.

The air suction means with the air suction port covering the entire powder material spray port for upper punch is provided above the powder material spray port for upper punch.

Thus, when the air suction means is driven, extra powder material which has been sprayed from the powder material spray port for upper punch and not applied on the material contacting surface of the upper punch is suck to be removed from the air suction port. Therefore, the members of the rotary type tabletting machine which should not be applied with powder material aren't polluted by powder material.

As a result, if the powder material application apparatus uses lubricant powder as powder material, tablets without including lubricant powder can be effectively produced.

According to the present invention, the powder material application apparatus further comprises a suction port for lower punch under the powder material application part for lower punch; and an air suction means provided in forward direction of rotation of the turntable from the position of the powder material spray port for lower punch and provided apart from the powder material spray port for lower punch so as not to communicate the suction port for lower punch and the powder material spray port for lower punch by the die moving under the powder material application part for lower punch according to the rotation of the turntable.

The suction port for lower punch is provided at the lower part of the powder material application part for lower punch and still further the air suction means is provided, thereby removing extra powder material attached on the lower punch, the die and the turntable. Therefore, such extra powder material is prevented from being mixed with molding material. As a result tablets without including lubricant powder can be effectively produced when the powder material application apparatus uses lubricant powder as powder material.

According to the powder material application apparatus of the present invention, the powder material mixed with air is lubricant powder.

Lubricant powder mixed with air is sequentially applied on each material contacting surface of plural dies provided on the turntable of the rotary tabletting machine, each material contacting surface of plural upper punches inserted in a fixed position in each die and each material contacting surface of plural upper punches so that lubricant powder is surely applied on the material contacting surface of the upper punch on which lubricant powder isn't easily applied by gravity.

In addition, powder material sprayed from the powder material spray port for lower punch through the first communication passage of the powder material application apparatus is supplied into the powder material spray port for upper punch.

Therefore, extra powder material which is apt to be accumulated on the material contacting surface of the lower punch on which material is easily attached by gravity is blown off to the powder material spray port for upper punch.

As a result, extra lubricant powder is blown out of the material contacting surface of the lower punch on which material is apt to be accumulated by gravity, and the blown lubricant powder is applied on the material contacting surface of the upper punch on which lubricant powder is hardly applied by gravity. Thus the application amount of lubricant powder on the material contacting surface of the lower punch which is easily applied with lubricant powder and that on the material contacting surface of the upper punch which is hardly applied with lubricant powder become the same or substantially same.

Therefore, when lubricant is sequentially applied on each material contacting surface of plural dies provided on the turntable of the rotary type tabletting machine, each material contacting surface of plural lower punches inserted in a fixed position in each one of plural dies, and each material contacting surface of plural upper punches, lubricant powder is uniformly applied on each material contacting surface of dies, upper punches and lower punches. Then at a molding material charge position of the rotary type tabletting machine, molding material is charged in the cavity formed by the die on which material contacting surface lubricant powder is applied and the lower punch which is inserted in the die and on which material contacting surface is applied with lubricant powder. At a compression position of the rotary type tabletting machine, the charged molding material is compressed with the lubricated die, the lubricated lower punch and the lubricated upper punch, thereby producing tablets without including lubricant, without causing grinding of the punches and dies of the rotary type tabletting machine and without causing sticking, lamination, capping and so on.

According to the tablet production method by means of the above-mentioned powder material application apparatus of the present invention, powder material is applied on the material contacting surfaces of the die, the lower punch and the upper punch of the rotary type tabletting machine and molding material is compressed by means of the die, the lower punch and the upper punch of which material contacting surfaces are applied with powder material.

Powder material is applied on the material contacting surfaces of the dies, the lower punches and the upper punches of the rotary type tabletting machine, thereby preventing grinding of the dies, the lower punches and the upper punches when molding material is compressed by means of the dies, the lower punches and the upper punches on which material contacting surfaces are applied with powder material. In addition, tabletting problems such as sticking aren't caused on produced tablets.

BEST MODE FOR CARRYING OUT THE INVENTION

Figure 1:
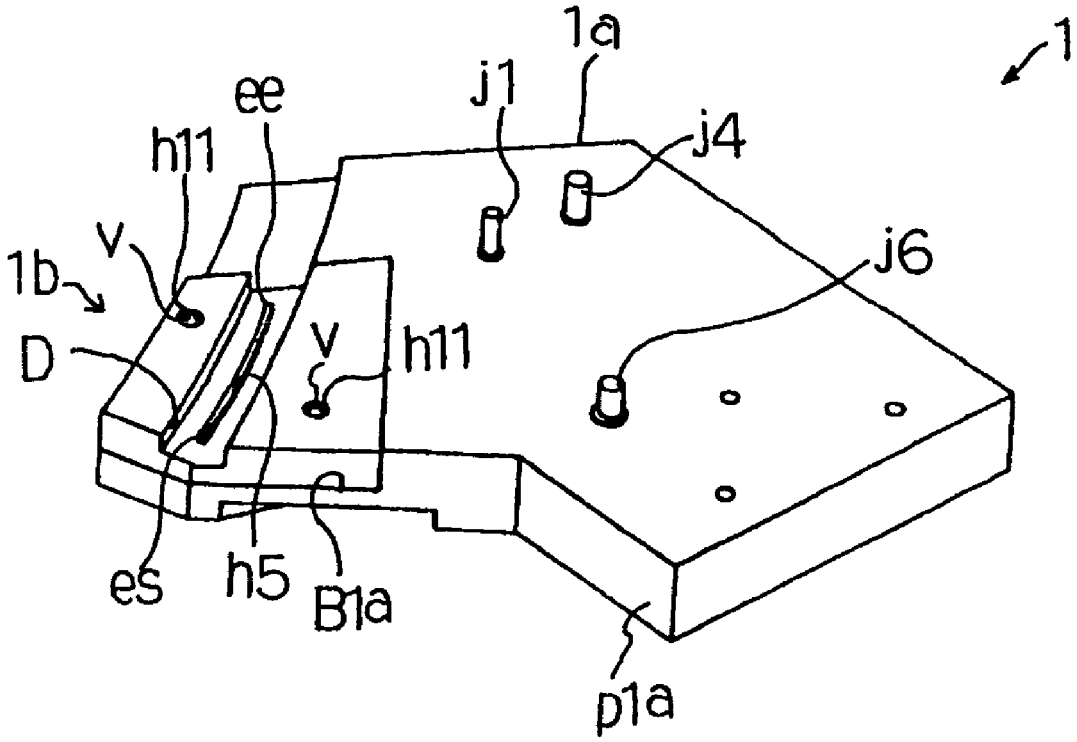
FIG. 1 is a perspective view diagrammatically showing one embodiment of a lubricant spray means of the present invention.

The present invention is detailed referring to the drawings.

In the following description, lubricant powder is used as powder material.

Preferable embodiments of the present invention are explained referring to the attached drawings.

(Embodiment of Invention 1)

FIG. 1 is a perspective view diagrammatically showing one embodiment of a powder material application apparatus (lubricant spray means) of the present invention.

Figure 2:
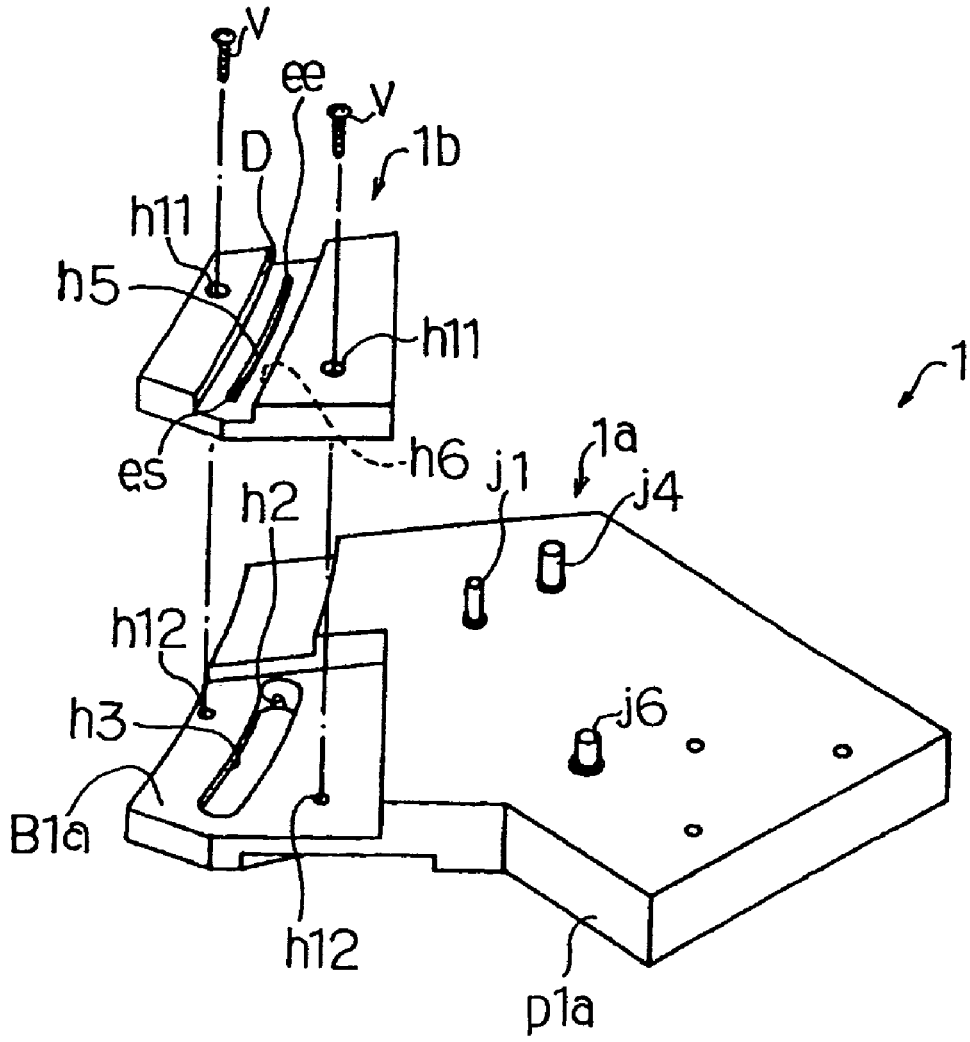
FIG. 2 is an exploded view diagrammatically showing the concept of one embodiment of a lubricant spray means of the present invention.

FIG. 2 is an exploded view diagrammatically showing the concept of one embodiment of a powder material application apparatus (lubricant spray means) of the present invention.

The powder material application apparatus (lubricant application apparatus) 1 has a powder material application part for lower punch 1*a* and a powder material application part for upper punch 1*b*.

The powder material application apparatus (lubricant application apparatus) 1 is newly constructed such that the powder material application part for upper punch 1*b* is separately provided for the powder material application part for lower punch 1*a* in such a manner that the powder material application part for upper punch 1*b* is exchangeable for the powder material application part for lower punch 1*a*, not that the application parts 1*a* and 1*b* are integrally formed.

In this embodiment, the powder material application part for lower punch 1*a* is formed as a resin block with grooves and recesses at predetermined positions and the powder material application part for upper punch 1*b* is also formed as a resin block with grooves and recesses at predetermined positions.

Detailed shape and construction of the powder material application part for lower punch 1*a* and the powder material application part for upper punch 1*b* are explained later.

Figure 3:
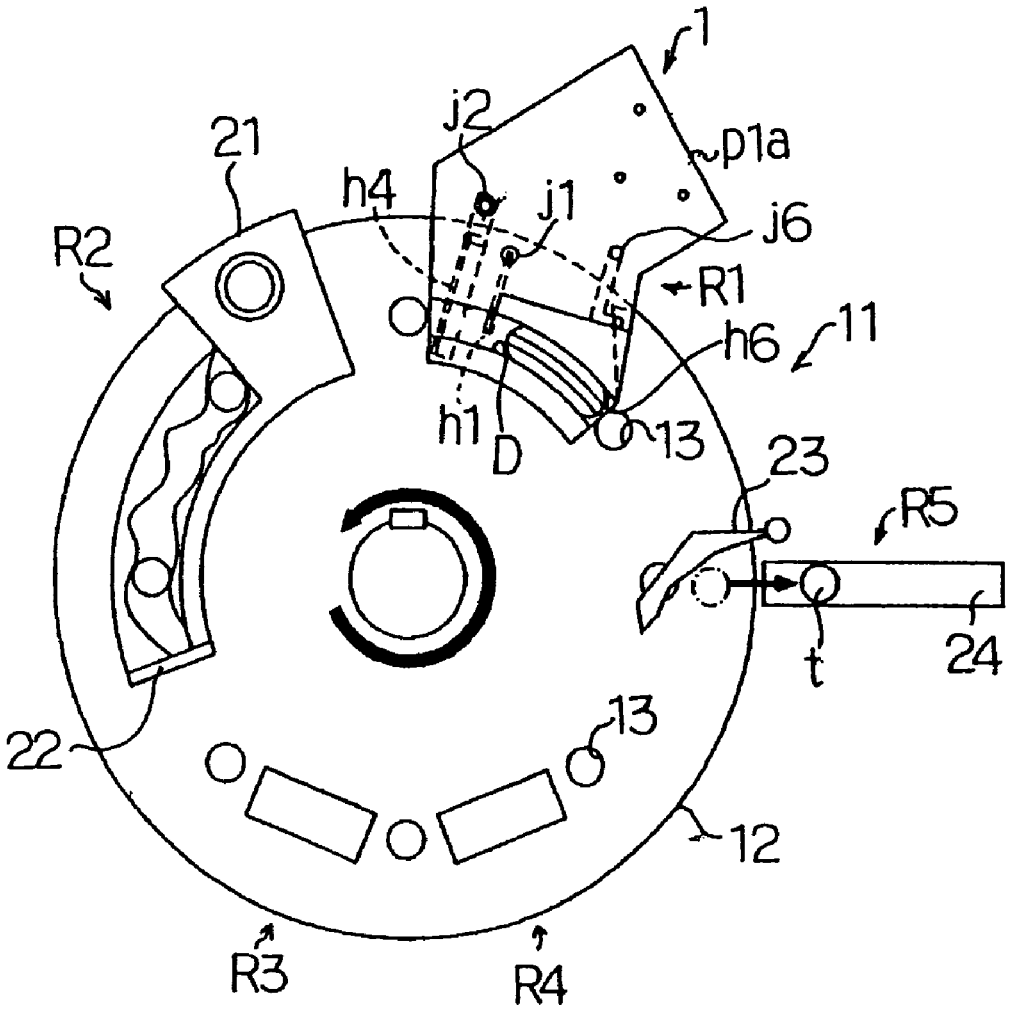
FIG. 3 is a plan view diagrammatically explaining where a powder material application apparatus (lubricant application apparatus) of the present invention is provided.

FIG. 3 is a plan view diagrammatically explaining where the powder material application apparatus (lubricant application apparatus) 1 of the present invention is provided.

More specifically, FIG. 3 is a plan view diagrammatically explaining a rotary type tabletting machine 11 around a turntable 12.

The rotary type tabletting machine 11 has the turntable 12 rotatably provided against a rotary axis.

Plural dies 13 . . . are formed in the circumferential direction on the turntable 12.

Plural lower punches (see lower punch 14 in FIG. 5) and plural upper punches (see upper punch 15 in FIG. 5) are provided so as to correspond to each one of plural dies 13 . . . .

Each one of plural lower punches (see lower punch 14 in FIG. 5) and each one of plural upper punches (see upper punch 15 in FIG. 5) are designed to be rotated in synchronism with each one of plural dies 13 . . . provided on the turntable 12, more specifically on the circumference of the turntable 12.

In addition, plural lower punches (see lower punch 14 in FIG. 5) and plural upper punches (see upper punch 15 in FIG. 5) are designed to go up and down in the rotary axial direction at a predetermined position of the turntable 12 by means of a cam mechanism (not shown).

The member 21 shown in FIG. 3 is a feed shoe for charging molding material in the dies 13 . . . , the member 22 shows a scraper for making the charged material in the dies 13 . . . to a fixed amount and the member 23 shows a tablet discharge scraper for discharging a produced tablet t to a discharge chute 24.

The position R1 in FIG. 3 is a powder material spray position (lubricant spray position).

The position R2 is a molding material charge position and is provided with the feed shoe 21 according to this rotary type tabletting machine 11.

Figure 5:
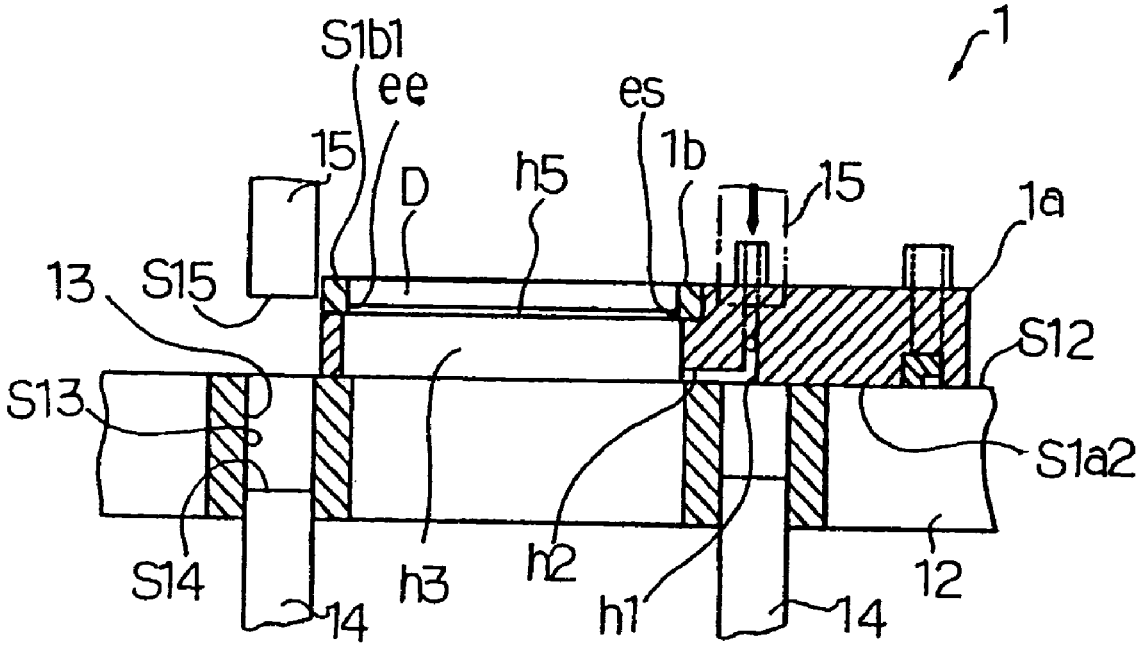
FIG. 5 is a sectional view diagrammatically showing a powder material application apparatus (lubricant application apparatus) of the present invention along a line V—V in FIG. 4.

The position R3 is a pre-tabletting position of the rotary type tabletting machine 11 where the molding material charged in each one of the dies 13 . . . is sequentially pre-tabletted by means of each die 13 . . . , corresponding lower punch (see lower punch 14 in FIG. 5) and corresponding upper punch (see upper punch 15 in FIG. 5).

The position R4 is a main tabletting position where the pre-tabletted molding material in the die 13 . . . is compressed by means of each die 13 corresponding lower punch (see lower punch 14 in FIG. 5) and corresponding upper punch (see upper punch 15 in FIG. 5) in earnest, thereby sequentially producing a tablet t . . . .

The position R5 is a tablet discharge position of the rotary type tabletting machine 11 where each lower punch (lower punch 14 in FIG. 5) goes up in the die 13 . . . . to sequentially discharge the produced tablet t . . . out of the die 13 . . . using the tablet discharge scraper 23 to a discharge chute 24.

Next, construction of the powder material application apparatus (lubricant application apparatus) 1 of the present invention and a method for attaching the application apparatus 1 to the rotary type tabletting machine 11 are explained.

The powder material application apparatus (lubricant application apparatus) 1 of the present invention is provided between the tablet discharge position R5 and the molding material charge position R2.

Figure 4:
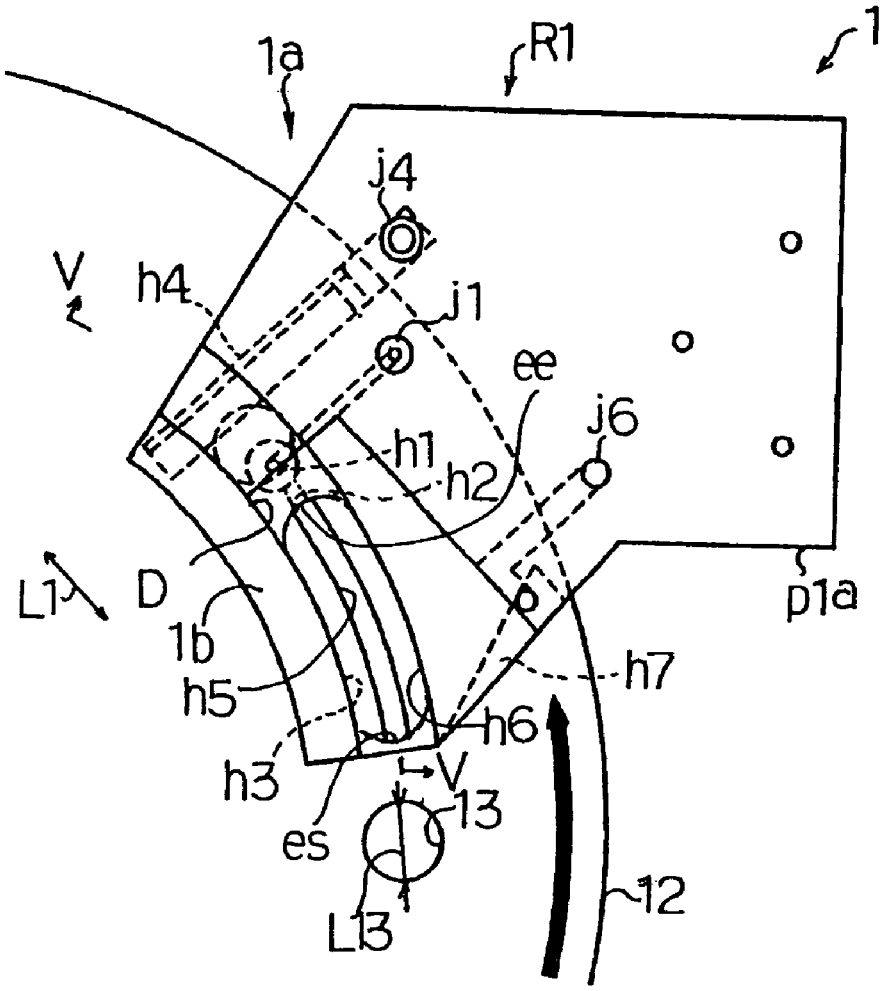
FIG. 4 is a plan view diagrammatically showing an enlarged part where a powder material application apparatus (lubricant application apparatus) of the present invention is attached to a lubricant spray position of a rotary type tabletting machine.

FIG. 4 is a plan view diagrammatically showing an enlarged powder material application apparatus (lubricant application apparatus) 1 of the present invention attached to the lubricant spray position R1 of the rotary type tabletting machine 11.

FIG. 5 is a sectional view diagrammatically showing the powder material application apparatus (lubricant application apparatus) 1 of the present invention along a line V—V in FIG. 4.

The powder material application part for lower punch la consisting of the powder material application apparatus (lubricant application apparatus) 1 has a pedestal p1*a*.

For attaching the powder material application part for lower punch 1*a* on the turntable 12, the pedestal p1*a* is rendered to be extended out of the turntable 12 and is attached to the attachment for application body (not shown) such as a stand provided at a predetermined position outside of the turntable 12.

Further, the powder material application part for lower punch 1*a* is attached on the turntable 12 in such a manner that a material contacting surface (lower surface) S1*a*2 of the application part 1*a* is substantially in contact with the surface S12 of the turntable 12.

The material contacting surface (lower face) S1*a*2 of the powder material application part for lower punch 1*a* is finely ground so as to smoothly rotate the turntable 12 getting in contact with the material contacting surface S1*a*2 of the application part 1*a*.

It is preferable that the material contacting surface (lower surface) S1*a*2 of the powder material application part for lower punch 1*a* comes into contact with or comes close to the surface S12 of the turntable 12.

When the material contacting surface (lower surface) S1*a*2 of the powder material application part for lower punch 1*a* comes close to the surface S12 of the turntable 12, it is more preferable that the gap between the surface S1*a*2 of the application part 1*a* and the surface S12 of the turntable 12 is smaller.

More specifically, the gap between the material contacting surface (lower surface) S1*a*2 of the powder material application part for lower punch 1*a* and the surface S12 of the turntable 12 is preferably less than or equal to 100 μm, more preferably less than or equal to 50 μm and still more preferably less than or equal to 30 μm.

Thus, when the gap between the material contacting surface (lower surface) S1*a*2 of the powder material application part for lower punch 1*a* and the surface S12 of the turntable 12 becomes small, powder material (lubricant powder in this embodiment) can be prevented from scattering outside through this gap.

Further, a suction recess h7 is provided on the material contacting surface (lower surface) S1*a*2 of the powder material application part for lower punch 1*a* so as to remove dirt (residual molding material and/or residual powder material (lubricant powder in'this embodiment)) attached on the surface S12 of the turntable 12 or in the die 13 . . . and to clear on the turntable 12 or in the die 13 . . . .

In this embodiment, a connection port j6 is connected to both of a suction port for upper punch h6 and the suction recess h7 in such a manner that an extra lubricant suction means (not shown) connected with the connection port j6 is driven to generate both a suction mode air flow directing to the suction port for upper punch h6 therearound and a suction mode air flow directing to the suction recess h7 therearound. It is one of exemplifications and the connection port j6 isn't required for both of the suction port for upper punch h6 and the suction recess h7. It may be connected only to the suction port for upper punch h6 and a connection port (not shown) other than the connection port j6 is connected to the suction recess h7, a suction mean (not shown) which connected to other suction port (not shown) is connected to the suction recess h7 so that the extra lubricant suction means (not shown) is driven to generate suction mode air flow directing to the suction port for upper punch h6 therearound and the suction means connected to other connection port (not shown) is driven to generate suction mode air flow directing to the suction recess h7 therearound.

The powder material application part for lower punch 1*a* has a powder material spray port for lower punch h1 on the material contacting surface (lower surface) S1*a*2 thereof.

The powder material spray port for lower punch h1 is provided so as to be on the rotary orbit of plural dies 13 . . . arranged in the circumferential direction on the turntable 12.

The powder material spray port for lower punch h1 is vertical or substantially vertical against the material contacting surface (lower surface) S1*a*2 of the powder material application part for lower punch 1*a*.

The powder material application part for lower punch 1*a* has a second communication passage h2 on the material contacting surface (lower surface) S1*a*2 thereof to supply the powder material (lubricant powder in this embodiment) to the powder material application part for upper punch 1*b*, the powder material being sequentially sprayed on the material contacting surface (inner circumference) S13 of the die 13 transferred to the material spray position (lubricant spray position) R1 by the rotation of the turntable 12 and on the lower punch (see lower punch 14 in FIG. 5) inserted into a predetermined position in the die 13 from the powder material spray port for lower punch h1.

In this embodiment, the powder material application part for lower punch 1*a* has a recessed groove on the material contacting surface (lower surface) S1*a*2 thereof so as to communicate between the powder material spray port for lower punch h1 and the powder material spray part for upper punch 1*b*. The second communication passage h2 is defined by the recessed groove on the material contacting surface S1*a*2 of the powder material application part 1*a* and the surface S12 of the turntable 12.

Further in this embodiment, a hollow chamber h3 with an upper open end is provided where the powder material application part for upper punch 1*b* is attached for the powder material application part for lower punch 1*a*. The second communication passage h2 is provided between the powder material spray port for lower punch h1 and the hollow chamber h3 so as to communicate therebetween.

The hollow chamber h3 is formed so as to be curved so as to agree with or substantially agree with the rotary orbit of plural dies 13 . . . in a plan view.

The powder material application part for lower punch 1*a* has a suction port for lower punch h4 in a forward direction of rotation of the turntable 12 of the material contacting surface (lower surface) S1*a*2 thereof.

A suction means for removing extra lubricant (not shown) comprised of a blower is connected to the suction port for lower punch h4 such that suction mode air flow toward the suction port for lower punch h4 is generated upon driving the suction means for removing extra lubricant.

The suction port for lower punch h4 is provided at a position which is apart from the powder material spray port for lower punch h1 and where the suction port for lower punch h4 and the powder material spray port for lower punch h1 aren't communicated by the dies 13 . . . moving under the powder material application part for lower punch 1*a* by the rotation of the turntable 12.

More specifically, in this embodiment, the suction port for lower punch h4 is provided where the length L1 between the suction port for lower punch h4 and the powder material spray port for lower punch h1 is larger than the diameter L13 of each die 13 . . . (L1>L13).

Further, the suction port for lower punch h4 is a long slit directing outward from the rotary axis of the turntable 12.

The suction port for lower punch h4 is arranged to be a length overstriding each one of plural dies 13 . . . passing under the suction port for lower punch h4 by the rotation of the turntable 12 in order that powder material (lubricant powder in this embodiment) exceedingly attached around the turntable 12 and each one of plural dies 13 . . . is effectively removed.

The powder material application part for upper punch 1*b* is exchangeably attached to the pedestal of the powder material application part for lower punch 1*a* as mentioned above.

In this embodiment, the powder material application part for upper punch 1*b* is attached to the powder material application part for lower punch 1*a* by means of a fixing means such as bolts v and v.

The apertures h11 and h11 in FIG. 2 are through holes for bolts provided for the powder material application part for upper punch 1*b* and the apertures h12 and h12 are engaging holes for bolts for screwing with fixing means such as bolts v and v.

The powder material application part for upper punch 1*b* has the powder material spray port for upper punch h5 on the material contacting surface (upper surface) S1*b*1.

The powder material spray port (opening) for upper punch h5 is formed as a long slit (penetrating aperture) along the rotary orbit of plural upper punches (see upper punch 15 in FIG. 5).

More specifically, the powder material spray port (opening) for upper punch h5 is a long slit (penetrating aperture)

so as to agree with or substantially agree with the rotary orbit of the plural upper punches (upper punch 15 in FIG. 5).

According to this powder material application apparatus (lubricant application apparatus) 1, the powder material spray port (opening) for upper punch h5 comes to above the hollow chamber h3 with an open end provided for the powder material application apparatus for lower punch 1*a* so as to communicate the hollow chamber h3 and the powder material application part for upper punch 1*b* after the powder material application part for upper punch 1*b* is attached to the powder material application part for lower punch 1*a*.

Because of such construction of the powder material application apparatus (lubricant application apparatus) 1, powder material (lubricant powder in this embodiment) which is sprayed from the powder material spray port for lower punch h1 and fed to the hollow chamber h3 via the second communication passage h2 provided so as to be communicated with the powder material spray port for lower punch h1 of the powder material application part for lower punch 1*a* is sprayed from the material spray port (opening) for upper punch h5.

The powder material application apparatus (lubricant application apparatus) 1 is characterized in that powder material (lubricant powder) isn't simultaneously applied on a pair of lower punch and upper punch.

Further in this embodiment, an upper punch accommodation groove D is provided for sequentially accommodating plural upper punches (see upper punch 15 in FIG. 5) along the slit-like powder material spray port (opening) for upper punch h5.

The powder material spray port (opening) for upper punch h5 is provided at the bottom of the upper punch accommodation groove D of the powder material application part for upper punch 1*b*.

The suction port for upper punch h6 is formed so as to entirely cover the powder material spray port (opening) for upper punch h5.

In this embodiment, the suction port for upper punch h6 is formed so as to construct a part of the side wall of the upper punch accommodation groove D and its entrance is curved along the rotary orbit of the plural upper punches (see upper punch 15 in FIG. 5).

Driving the suction means for upper punch (not shown), substantially uniform air flow toward the suction port for upper punch h6 from the powder material spray port (opening) for upper punch h5 is generated above the initial end es to the terminal end ee of the powder material spray port (opening) for upper punch h5 of the powder material application part for upper punch 1*b*.

The member j1 in FIG. 1, FIG. 2, FIG. 3 FIG. 4 and FIG. 5 is a connection port for a conduit for supplying powder material (lubricant powder in this embodiment) mixed with air to the powder material spray port for lower punch h1 of the powder material application part for lower punch 1*a*. Thus, connection port j1 provides a powder material supply port. The member j4 is a connection port for a conduit connecting between the suction port for lower punch h4 and the suction means for removing extra lubricant (not shown) and the member j6 is a connection port for a conduit connecting between the suction port for upper punch h6 and the suction means for upper punch (not shown).

In this embodiment, the connection ports j1, j4 and j6 are provided on the material contacting surface (upper surface) of the pedestal p1*a* of the powder material application part for lower punch 1*a* so as to facilitate connection thereof.

Next, operations for producing tablets by the rotary type tabletting machine 11 are explained.

For producing tablets using the rotary type tabletting machine 11, the powder material application part for lower punch 1*a* is attached to the lubricant spray position R1.

The powder material application part for lower punch 1*a* is fixedly attached to the powder material spray position (lubricant spray position) R1 on the turntable 12 in such a manner that the material contacting surface (lower surface) S1*a*2 of the powder material application part for lower punch 1*a* comes to contact with the surface S12 of the turntable 12 and the powder material spray port for lower punch h1 is positioned on the rotary orbit of the plural dies 13 . . . arranged in a circumferential direction on the turntable 12.

Next, the powder material application part for upper punch 1*b* is provided for the powder material application part for lower punch 1*a*.

The powder material (lubricant powder in this embodiment) mixed with air is supplied to the powder material spray port for lower punch h1 from the powder material supply source (lubricant supply source, not shown) connected via the conduit connected to the connection port j1.

For the connection port j1, several kinds of powder material supply means may be used if it can supply powder material mixed with air.

One example of such a powder material supply means is the one (see JP-A-5-238544) for transferring powder material mixed with air out of a tubule which is comprised of a body of revolution with a circumferential groove for charging powder material at the periphery, a tubule arranged such that an opening opposes to the circumferential groove of the body at a fixed space, means for supplying powder material into the circumferential groove of the body under pressure, a scraper for removing extra powder material from the surface of the body and smoothing the surface of the powder material supplied in the groove and means for giving pressure difference so as to flow air into the tubule from the space where the body is positioned in order to transfer the charged powder material out of the groove into the tubule together with air. Other well-known powder material supply means may be used.

On the other hand, a screw feeder may be provided for a material discharge port of a powder material storage tank and powder material taken out of the material storage tank by rotating the screw feeder may be discharged into a conduit in which air is flowing to be mixed and to be pneumatically transported to a desired place.

Next, the turntable 12, plural lower punches (see lower punch 14 in FIG. 5) and plural upper punches (see upper punch 15 in FIG. 5) are rotated at a fixed rotational speed in synchronism each other.

Molding material to be tabletted is supplied in a feed shoe 21.

Lubricant powder which is used for preventing tabletting problems on the tablets produced by the rotary type tabletting machine 11 isn't added in the supplied molding material.

However, it doesn't forbid lubricant to be added in the molding material for the purpose of improving fluidity of molding material or in order to accord disintegration characteristic and dissolution characteristic of the tablet with those of the tablet produced by molding material including lubricant powder.

The suction means for upper punch (not shown) connected via the conduit connected to the connection port j6 is driven at a fixed driving amount.

If the suction port for lower punch h4 is provided for the powder material application part for lower punch 1*a*, the suction means for removing extra lubricant (not shown) connected to the suction port for lower punch h4 is driven at a fixed driving amount.

Further, if the suction port for upper punch h6 is provided at the upper part of the powder material spray port for upper punch h5 of the powder material application part for upper punch 1*b*, the suction means for upper punch (not shown) connected to the suction port for upper punch h6 is driven at a fixed driving amount.

According to the above-mentioned procedures, next explained is a method (operation and principle) for applying powder material (lubricant in this embodiment) on the material contacting surface (inner circumference) S13 of each one of plural dies 13 . . . provided on the turntable 12, the material contacting surface (lower surface) S14 . . . of each one of plural lower punches (see lower punch 14 in FIG. 5) and the material contacting surface (lower surface) S15 . . . of plural upper punches (see upper punch 15 in FIG. 5) by means of the powder material application apparatus (lubricant spray means) 1.

Figure 6:
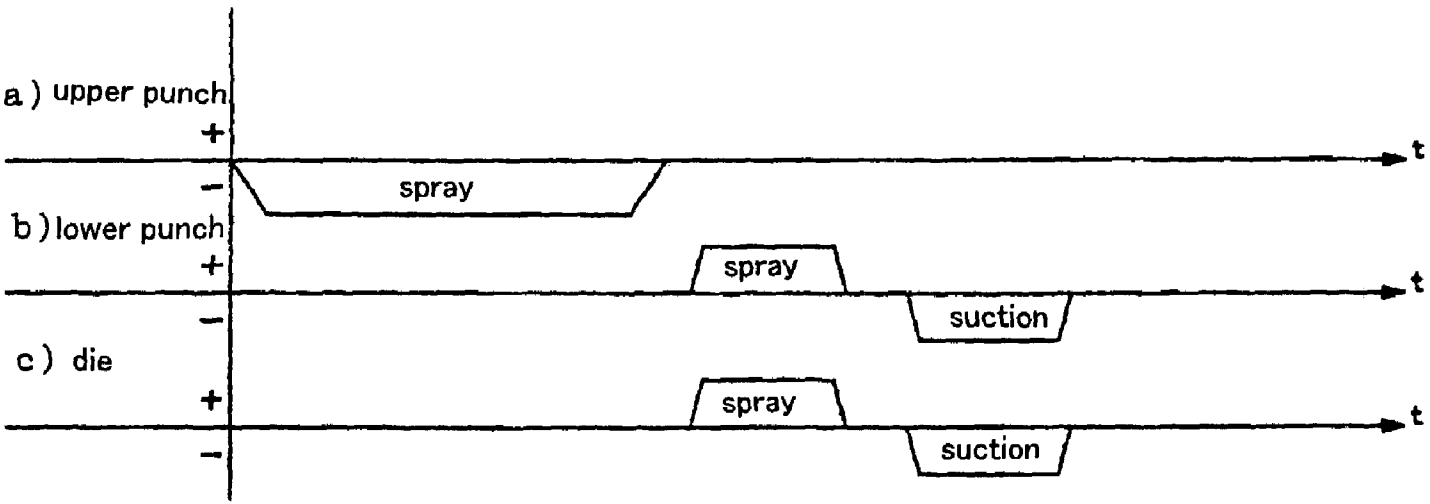
FIG. 6 is a time chart showing a method (operation and principle) for applying powder material on the material contacting surface of die, the material contacting surface of lower punch and the material contacting surface of upper punch by the powder material application apparatus of the present invention.

FIG. 6 is a time chart diagrammatically showing the method (operation and principle) for applying powder material on the material contacting surface (inner circumference) S13 of the die 13, the material contacting surface (upper surface) S14 of the lower punch (see lower punch 14 in FIG. 5) and the material contacting surface (upper surface) S15 of the upper punch 15 of the powder material application apparatus (lubricant application apparatus) 1.

When the turntable 12, plural lower punches (see lower punch 14 in FIG. 5) and plural upper punches (see upper punch 15 in FIG. 5) are rotated, plural dies 13 . . . provided on the turntable 12, the lower punches and the upper punches are sequentially transported to the lubricant spray position R1.

First explained is the operation and principle of applying lubricant on the material contacting surface (inner circumference) S13 . . . of each one of plural dies 13 . . . and the material contacting surface (upper surface) S14 . . . of each one of plural lower punches (see lower punch 14 in FIG. 5) by means of the powder material application part for lower punch 1*a* of the powder material application apparatus (lubricant spray means) 1.

FIG. 5 exemplifies plural dies 13 and 13, plural lower punches 14 and 14 and plural upper punches 15 and 15 which are thus transported to the lubricant spray position R1.

More specifically, the die 13 corresponding to the upper punch 15 shown with imaginary lines among two upper punches 15 and 15 is just transported under the powder material spray port for lower punch h1 provided for the material contacting surface (lower surface) S1*a*2 of the powder material application part for lower punch 1*a* and on the surface S14 of the lower punch 14 inserted in a predetermined position in the die 13. At this time powder material (lubricant powder) mixed with air is sprayed.

As shown in FIG. 5, because the powder material spray port for lower punch h1 is in perpendicular or in substantially perpendicular against the material contacting surface (lower surface) S1*a*2 of the powder material application part for lower punch 1*a*, lubricant sprayed from the spray port for lower punch h1 together with air is applied in substantially vertical direction on the surface S14 of the lower punch 14 inserted in a predetermined position in the die 13 which is transported under the spray port h1.

According to this powder material application apparatus (lubricant application apparatus) 1, powder material (lubricant powder in this embodiment) mixed with air is sprayed on the material contacting surface (upper surface) S14 of the lower punch 14 inserted in a predetermined position in the die 13 transported under the spray port h1 when the turntable 12 is rotated. Therefore, lubricant which is apt to be adhered on the material contacting surface (upper surface) S14 of the lower punch 14 under gravity is blown off by air so that extra lubricant doesn't adhere on the surface (upper surface) S14 of the lower punch 14.

The lubricant blown out of the material contacting surface (upper surface) S14 of the lower punch 14 by air adheres on the material contacting surface (inner circumference) S13 (more specifically on the molding material contacting surface, or still more specifically on the surface above the material contacting surface (upper punch) of the lower punch of the material contacting surface (inner circumference) of the die) of the die.

Further according to the powder material application apparatus (lubricant application apparatus) 1, the second communication passage h2 is designed so as to communicate the powder material spray port for lower punch h1 and the hollow chamber h3 so that the lubricant exceedingly applied on the material contacting surface (upper face) S14 of the lower punch 14 and the material contacting surface (inner circumference) S13 of the die 13 is fed into the hollow chamber h3 via the second communication passage h2 together with air.

Still further according to the powder material application apparatus (lubricant application apparatus) 1, air flow from the powder material spray port for lower punch h1 into the hollow chamber 3 is generated in the second communication passage h2 when the suction means for upper punch (not shown) is driven at a fixed amount. Therefore, extra lubricant for the material contacting surface (upper surface) S14 of the lower punch 14 and the material contacting surface (inner circumference) of the die 13 is guided to the powder material application part for upper punch 1*b*.

As a result, because the extra lubricant on the material contacting surface (upper surface) S14 of the lower punch 14 and the material contacting surface (inner circumference) S13 of the die 13 is introduced into the powder material application part for upper punch 1*b* of the powder material application apparatus (lubricant application apparatus) 1, such extra lubricant doesn't adhere on the material contacting surfaces of the lower punch 14 and the die 13.

In addition, according to the powder material application apparatus (lubricant application apparatus) 1, the suction port for upper punch h6 is formed to entirely cover the powder material spray port for upper punch h5 of the powder material application part for upper punch 1*b*. As a result, when the suction means for upper punch (not shown) is driven at a fixed driving amount, a uniform flow directing from the material spray port for upper punch h5 to the suction port for upper punch h6 is generated from an initial end es to the terminal end ee of the powder material spray port for upper punch h5 formed like a slit curving along the rotary orbit of plural upper punches (see upper punch 15 in FIG. 5). Lubricant is thoroughly sprayed riding on the uniform flow from the initial end es to the terminal end ee of the powder material spray port for upper punch h5.

After a fixed time from the condition shown in FIG. 5, the die 13 which corresponds to the upper punch 15 shown with imaginary lines among two upper punches 15 and 15 is transferred into the downstream of the powder material spray port for lower punch h1, which is provided for the material contacting surface (lower surface) S1*a*2 of the powder material application part for lower punch 1*a*, between the powder material spray port for lower punch h1 and the suction port for lower punch h4.

Under such condition, the powder material spray port for lower punch h1 is closed by the surface S12 of the turntable 12 so that lubricant isn't sprayed on the dies 13 . . . formed on the turntable 12 and plural lower punches (see lower punch 14 in FIG. 5) inserted in a predetermined position in each one of the dies 13 . . . .

Therefore, lubricant isn't sprayed other than the dies 13 . . . on the turntable 12 by the powder material application apparatus (lubricant application apparatus) 1.

Accordingly, lubricant attached around plural dies 13 . . . on the turntable 12 doesn't fall in the dies 13 . . . at the molding material charge position R2 of the powder material application apparatus (lubricant application apparatus) 1 so that lubricant isn't included in molding material.

As a result, tablets without being contaminated by lubricant therein can be produced by the powder material application apparatus (lubricant application apparatus) 1.

An electromagnetic valve (not shown) and an electromagnetic control means for opening and closing the electromagnetic valve (not shown) may be provided for the powder material application apparatus (lubricant application apparatus) 1. In such a case, lubricant isn't required to be intermittently sprayed (clock pulse blowing) when each one of dies 13 . . . is transferred under the powder material spray port for lower punch h1 by the rotation of the turntable 12. Lubricant can be sprayed on each die 13 . . . formed on the turntable 12 and each lower punch (see lower punch 14 in FIG. 5) inserted in a predetermined position in the die 13 . . . only when each die 13 . . . is transferred under the powder material spray port for lower punch h1. As a result, the same effect as intermittent spraying of lubricant (clock pulse blowing) can be obtained without complicating the construction of the apparatus when each die 13 . . . is transferred under the powder material spray port for lower punch h1.

According to such constructed powder material application apparatus (lubricant application apparatus) 1, the area other than each surface (material contacting surface (inner circumference)) S13 . . . of the dies 13 . . . , each surface (material contacting surface (upper surface)) S14 . . . of the lower punch (see lower punch 14 in FIG. 5) and each surface (material contacting surface (lower surface)) S15 . . . of the upper punch (see upper punch 15 in FIG. 5) is prevented from being contaminated with powder material (lubricant powder).

Figure 15:
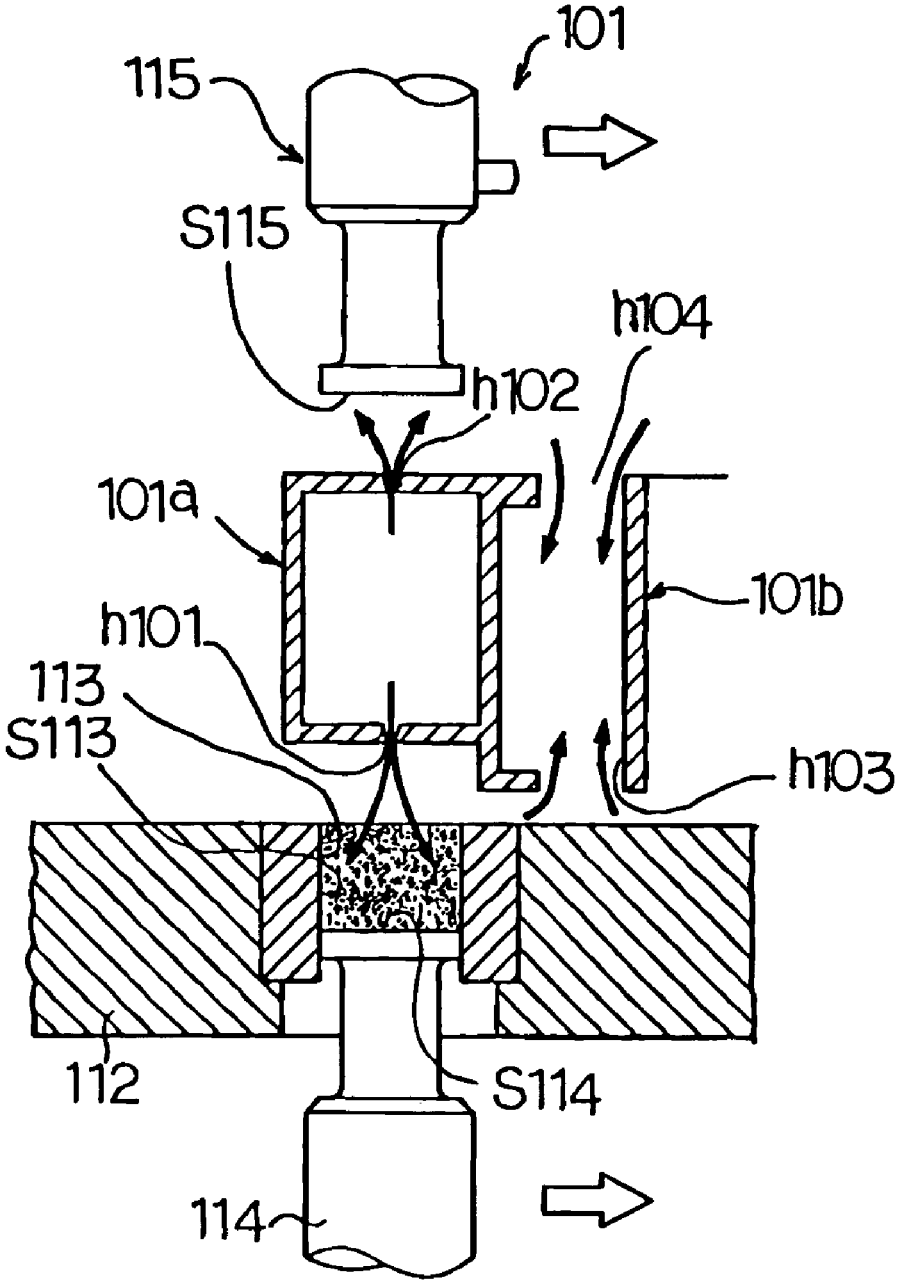
Fig.15 PRIOR ART
FIG. 15 is a sectional view diagrammatically showing one embodiment of conventional powder material application apparatus.

In addition, according to the powder material application apparatus (lubricant application apparatus) 1, the material contacting surface (lower surface) S1*a*2 of the powder material application part for lower punch 1*a* and the surface S12 of the turntable 12 are constructed to be in touch each other. Therefore, cloud like powder material (lubricant material), which is inevitably caused when the lower surface of the powder material application apparatus (lubricant application apparatus) 101 is provided apart from the surface of the turntable 212, isn't generated between the powder material spray port for lower punch h101 and the die 113 when powder material is sprayed from the powder material spray port for lower punch h101 together with air, as shown in FIG. 15.

Further according to the above-mentioned, the area other than each surface (material contacting surface (inner circumference)) S13 . . . of the dies 13 . . . , each surface (material contacting surface (upper surface)) S14 . . . of the lower punch (see lower punch 14 in FIG. 5) and each surface (material contacting surface) (lower surface)) S15 . . . of the upper punch (see upper punch 15 in FIG. 5) is prevented from being contaminated with powder material (lubricant powder).

On the other hand, according to the powder material application apparatus (lubricant application apparatus) 1, the second communication port h2 is provided so as to communicate the powder material spray port for lower punch h1 and the hollow chamber h3. Therefore, lubricant is transferred to the hollow chamber h3 via the second communication passage h2 together with air even when each die 13 . . . doesn't come under the powder material spray port for lower punch h1 and lubricant isn't sprayed on each one of plural dies 13 . . . from the powder material spray port for lower punch h1.

Thus, powder material (lubricant powder) is continuously sprayed from the powder material spray port for upper punch h5 of the powder material application part for upper part 1*b* when powder material (lubricant powder) isn't sprayed in each one of the dies 13 . . . from the powder material spray port for lower punch h1.

In addition, suction mode flow into the suction port for lower punch h4 is generated by driving the suction means for removing extra lubricant (not shown) connected to the suction port for lower punch h4 so that powder material (lubricant powder) additionally attached on the material contacting surface (inner circumference) S13 of the die 13 transferred under the suction port for lower punch h4 and/or the material contacting surface (upper surface) S14 of the lower punch 14 inserted in a predetermined position in the die 13 is removed.

Further, in this embodiment, the suction port for lower punch h4 is provided at a position which is apart from the powder material spray port for lower punch h1 and where the suction port for lower punch h4 and the powder material spray port for lower punch h1 aren't communicated by the dies 13 . . . being transferred under the powder material application part for lower punch 1*a* by the rotating turntable 12.

As the result, according to the powder material application apparatus (lubricant application apparatus) 1, because of the positional relation of the suction port for lower punch h4 and the powder material spray port for lower punch h1, the drive amount of suction mean for removing extra lubricant is controlled at random without affecting the spray amount of powder material (lubricant powder) from the powder material spray port for lower punch h1 on each material contacting surface (upper surface) S14 . . . of the lower punch (see lower punch 14 in FIG. 5) inserted in a predetermined position in the die 13 moving under the powder material application part for upper punch 1*b*. Therefore, the driving amount of suction means for removing extra lubricant is suitably controlled for removing the lubricant additionally adhered by gravity on each material contacting surface (upper surface) S14 . . . of the plural lower punches (see lower punch 14 in FIG. 5), each material contacting surface (inner circumference) S13 . . . of plural dies 13 . . . and the area around the dies 13 . . . on the turntable 12.

Therefore, according to the powder material application apparatus (lubricant application apparatus) 1, minimum amount of powder material (lubricant powder) is uniformly applied on each one of the material contacting surfaces (upper surface) of plural lower punches on which powder material (lubricant powder) is additionally adhered by gravity, thereby effectively producing tablets on the entire surface of which minimum powder material (lubricant powder) is applied.

In addition, according to the powder material application apparatus (lubricant application apparatus) 1, powder material (lubricant powder) attached around each one of plural dies 13 . . . on the turntable 12 is completely removed so that powder material (lubricant powder) attached around the dies 13 . . . doesn't fall in the dies 13 . . . at the molding material charge position R2, thereby eliminating inclusion of powder material (lubricant powder) in molding material.

As a result, according to the powder material application apparatus (lubricant application apparatus) 1, tablets without being contaminated with lubricant therein can be produced.

On the other hand, according to the powder material application apparatus (lubricant application apparatus) 1, the second communication passage h2 is provided so as to communicate the powder material spray port for lower punch h1 and the hollow chamber h3 so that powder material (lubricant powder) is transferred to the hollow chamber h3 via the second communication passage h2 together with air even when each one of the dies 13 . . . doesn't come under the powder material spray port for lower punch h1 and powder material (lubricant powder) isn't sprayed in each one of the dies 13 . . . from the port h1.

Therefore, even if spraying of powder material (lubricant powder) isn't executed into the die 13 from the spray port for lower punch h1, powder material (lubricant) can be continuously sprayed from the powder material spray port for upper punch h5 of the powder material application part for upper punch 1*b*.

Next, operation and principle of applying powder material (lubricant powder) on each material contacting surface (lower surface) S15 . . . of plural upper punches (see upper punch 15 in FIG. 5) by the powder material application part for upper punch 1*b* of the powder material application apparatus (lubricant application apparatus) 1 are explained.

According to the powder material application apparatus (lubricant application apparatus) 1, powder material (lubricant powder) is applied on each material contacting surface (lower surface) S15 . . . of plural upper punches (see upper punch 15 in FIG. 5) as follows.

Referring to FIG. 5, when the die 13 corresponding to one of the upper punch 15, shown with imaginary lines, of two upper punches 15 and 15 is just transferred under the powder material spray port for lower punch h1 provided for the material contacting surface (lower surface) S1*a*2 of the powder material application part for lower punch 1*a*, application of lubricant on the material contacting surface (lower surface) S15 of the upper punch (see upper punch shown with imaginary lines in FIG. 5) corresponding to the die 13 transferred under the material spray port h1 provided for the surface (lower surface) S1*a*2 of the application part 1*a* has been already finished.

When the die 13 is under the powder material spray port for lower punch h1 provided for the material contacting surface (lower surface) S1*a*2 of the powder material application part for lower punch 1*a*, in this embodiment, next application of powder material (lubricant powder) on the material contacting surface (lower surface) S15 of next upper punch (see upper punch shown with solid lines in FIG. 5) is started.

In addition, the suction port for upper punch h6 is provided above the material contacting surface (lower surface) S15 . . . of the upper punch (see upper punch 15 in FIG. 5) passing above the material spray port for upper punch h5 of the powder material application part for upper punch 1*b*. Consequently, powder material (lubricant powder) is sequentially applied with time on each material contacting surface (lower surface) S15 of the upper punch (see upper punch 15 in FIG. 5) while the upper punch moves from the initial end es to the terminal end ee of the slit like powder material spray port for upper punch h5.

Namely, according to the powder material application apparatus (lubricant application apparatus) 1, powder material (lubricant powder) is applied for a long time on the material contacting surface (lower surface) S15 . . . of the upper punches (see upper punch 15 in FIG. 5) on which lubricant isn't easily applied by gravity comparing with on the material contacting surface (upper surface) S14 . . . of plural lower punches (see lower punch 14 in FIG. 5) on which lubricant is easily applied by gravity.

As a result, the powder material application part for upper punch 1*b* can apply minimum amount of powder material (lubricant powder) on each material contacting surface (lower surface) of the upper punches on which lubricant is hardly applied by gravity.

In addition, as mentioned above, the suction port for upper punch h6 is provided above the powder material application part for upper punch 1*b* so as to entirely cover the powder material spray port for upper punch h5 in this embodiment. Upon driving the suction means for upper punch (not shown) connected to the suction port for upper punch h6, a uniform air flow (which is a laminar flow from the material spray port for upper punch h5 to the suction port for upper punch h6) directing into the suction port for upper punch h6 from the powder material spray port for upper punch h5 is generated thoroughly from the initial end es to the terminal end ee of the suction port for upper punch h6 which is elongated like a slit so as to be curved along the rotary orbit of plural upper punches (see upper punch 15 in FIG. 5).

Thus, plural upper punches (see upper punch 15 in FIG. 5) rotating in synchronism with the turntable 12 are exposed in the powder material (lubricant powder) riding on the flow directing into the suction port for upper punch h6 from the slit-like powder material spray port for upper punch h5 while sequentially moving from the initial end es to the terminal end ee above the slit like spray port h5 of the powder material application part for upper punch 1*b*. Lubricant collides with each material contacting surface (lower surface) S15 of plural upper punches (see upper punch 15 in FIG. 5) so that powder material (lubricant powder) is sequentially and uniformly applied on each material contacting surface (lower surface) S15 of plural upper punches (see upper punch 15 in FIG. 5) on which lubricant isn't easily applied by gravity.

According to the powder material application apparatus (lubricant application apparatus) 1, application of lubricant under suction mode is executed for each material contacting surface (lower surface) S15 . . . of plural upper punches (see upper punch 15 in FIG. 5) on which powder material (lubricant powder) isn't easily applied by gravity. On the other hand, application of powder material (lubricant powder) under pressurizing mode is executed for each material contacting surface (upper surface) S14 of the lower punches (see lower punch 14 in FIG. 5) on which powder material (lubricant powder) is easily applied by gravity. Thus the application method of powder material (lubricant powder) on each material contacting surface (lower surface) S15 . . . of plural upper punches (see upper punch 15 in FIG. 5) is different from that on each material contacting surface (upper surface) S14 . . . of plural lower punches (see lower punch 14 in FIG. 5).

According to the powder material application apparatus (lubricant application apparatus) 1, suitable application method of powder material (lubricant powder) is used for each material contacting surface (lower surface) S15 . . . of plural upper punches (see upper punch 15 in FIG. 5) considering gravity. Therefore, lubricant can be uniformly applied also on the material contacting surface (lower surface) S15 . . . of plural upper punches (see upper punch 15 in FIG. 5) on which powder material (lubricant powder) isn't easily applied by gravity.

Extra powder material (lubricant powder) for each material contacting surface (lower surface) S15 . . . of plural upper punches 15 is sucked and removed into the suction port for upper punch h6, thereby enabling application of minimum amount of powder material (lubricant powder) on each material contacting surface (lower surface) S15 . . . of plural upper punches 15.

In addition, according to the above-mentioned suction and removal, the area other than the powder material application apparatus (lubricant application apparatus) 1 of the rotary type tabletting machine isn't contaminated by powder material (lubricant powder).

Therefore, tablets can be produced using the powder material application apparatus (lubricant spray means) 1 without being contaminated with powder material (lubricant powder).

Driving amount of suction means for upper punch (not shown) enables control of the application amount of powder material (lubricant powder) on each material contacting surface (upper surface) S14 . . . of plural lower punches (see lower punch 14 in FIG. 5) and on each material contacting surface (inner circumference) S13 . . . of plural dies 13 . . . .

Further according to the powder material application apparatus (lubricant spray means) 1, an upper punch accommodation groove D is provided along the slit like powder material spray port for upper punch h6 of the powder material application part for upper punch 1*b* to stay the powder material (lubricant powder) sprayed from the spray port h6 therein without being dispersed immediately. Consequently, powder material (lubricant powder) can be effectively applied on each material contacting surface (lower surface) S (see upper punch 15 in FIG. 5) of plural upper punches (see upper punch 15 in FIG. 5) on which powder material (lubricant powder) isn't easily applied while each one of plural upper punches (see upper punch 15 in FIG. 5) moves above and along the powder material spray port h6 in the upper punch accommodation groove D.

The powder material (lubricant powder) sprayed from the slit like material spray port for upper punch h6 is designed to stay in the upper punch accommodation groove D without dispersing immediately, thereby eliminating contamination of powder material (lubricant powder) on the area other than the upper punch accommodation groove D of the powder material application part for upper punch 1*b* of the rotary type tabletting machine.

Therefore, the powder material application apparatus (lubricant application apparatus) 1 can produce tablets without including powder material (lubricant powder).

Figure 7:
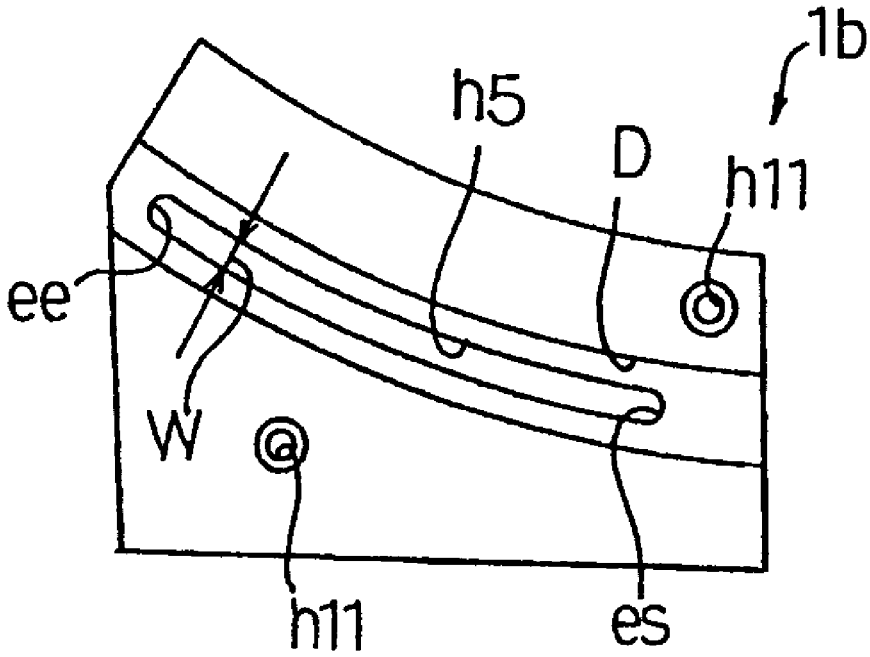
FIG. 7 is a plan view diagrammatically showing a powder material application part for upper punch.

FIG. 7 is a plan view diagrammatically showing the powder material application part for upper punch 1*b*.

The length (from the initial end es to the terminal end ee of the powder material spray port (opening) for upper punch h5) is preferably longer than the width W of the powder material spray port (opening) for upper punch h5 of the powder material application part for upper punch 1*b*.

When the powder material spray port (opening) for upper punch h5 of the powder material application part for upper punch 1*b* is constructed such that the direction along the rotary orbit of the upper punch is long and the width W perpendicular to the rotary orbit of the upper punch is short, powder material (lubricant powder) sprayed together with air from the material spray port (opening) for upper punch h5 is hardly scattered in the area other than the material contacting surface (see material contacting surface S15 of the upper punch 15 in FIG. 5) of the upper punch (see upper punch 15 in FIG. 5).

Consequently, members of the rotary tabletting machine 11 which should not be applied with the powder material are not polluted by the powder material by using the powder material application apparatus (lubricant application apparatus) 1.

Accordingly, if lubricant powder is used as powder material for the powder material application apparatus 1, tablets without including lubricant powder can be effectively produced.

Figure 8:
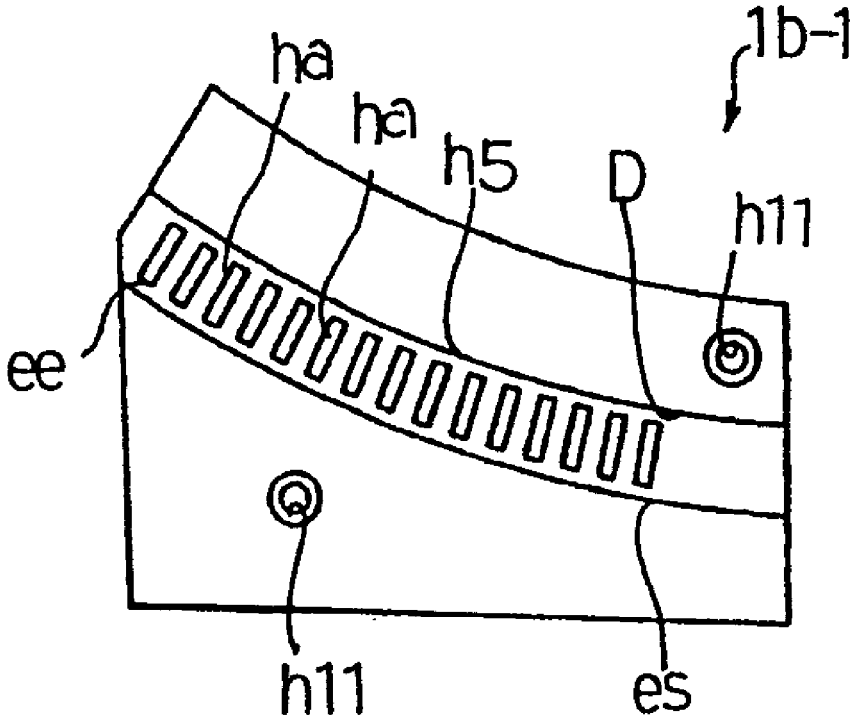
FIG. 8 is a plan view diagrammatically showing other embodiment of a powder material application part for upper punch.

FIG. 8 is a plan view diagrammatically showing other embodiment of a powder material application part for upper punch.

In the powder material application part for upper punch 1*b*-1, slit hole ha. . . is provided perpendicular to the rotary orbit of plural upper punches (see upper punch 15 in FIG. 5) passing above the upper surface of the powder material spray port (opening) for upper punch h5 by driving the rotary type tabletting machine 11 and several numbers of such slit hole ha. . . are aligned along the rotary orbit of plural upper punches (see upper punch 15 in FIG. 5).

Powder material (lubricant powder) mixed with air and sprayed from each one of slit holes ha . . . formed perpendicular to the rotary orbit of plural upper punches (see upper punch 15 in FIG. 5) is rectified by the slit ha . . . to flow upward from the material spray port (opening) for upper punch h5. Thus rectified powder material (lubricant powder) collides in substantially perpendicular to the material contacting surface (see material contacting surface S15 of the upper punch 15 in FIG. 5) of the upper punch (see upper punch 15 in FIG. 5).

Consequently, the powder material application part for upper punch 1*b*-1 can surely apply powder material (lubricant powder) on the material contacting surface (see material contacting surface S15 of upper punch 15 in FIG. 5) of the upper punch (see upper punch 15 in FIG. 5) on which powder material (lubricant powder) isn't hardly applied by gravity.

Figure 9:
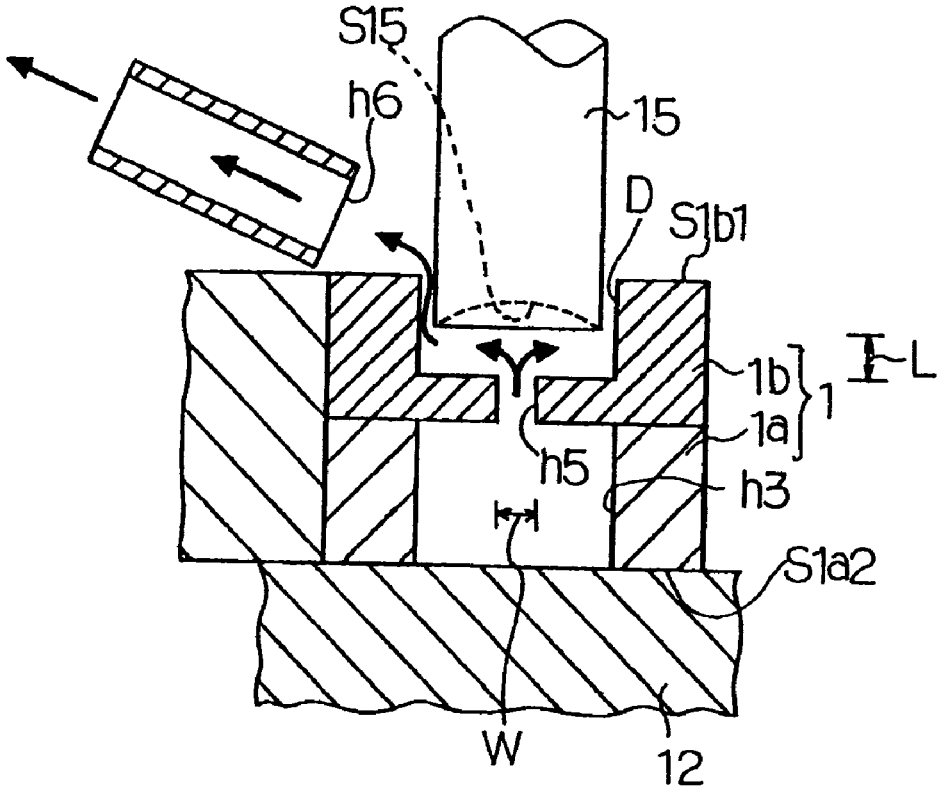
FIG. 9 is an explanatory view showing preferable relation of the distance between a material contacting surface of upper punch and a powder material spray port for upper punch and the width of the powder material spray port for upper punch.

FIG. 9 is an explanatory view showing a preferable relation of the distance L between the material contacting surface (lower surface) S15 of the upper punch 15 and the powder material spray port (opening) for upper punch h5 and the width W of the spray port h5.

When the distance L between the upper surface (where a slit hole h5 is provided in this embodiment) of the powder material application part for upper punch 1*b* and the material contacting surface (lower surface) S15 of the upper punch 15 passing above the surface of the application part 1*b* by driving the rotary type tabletting machine 11 and the width W of the powder material spray port (opening) for upper punch h5 of the application part 1*b* satisfy the following equation, the inventors of the present invention have found by experiments that powder material (lubricant powder) sprayed with air from the spray port (opening) h5 is easily applied on the material contacting surface (lower surface) of the upper punch 15 passing above the port h5 and isn't hardly scattered in other directions.

$$L = W \times \alpha$$

L: distance between the upper surface of the powder material application part for upper punch and the material contacting surface of upper punch passing above the surface of the application part according to the rotation of the rotary tabletting machine W: width of the powder material spray port for upper punch of the powder material application part for upper punch α: constant number equal to or above 1 and equal to or less than 30

It is preferable α is equal to or above 1 and equal to or less than 8, more preferably equal to or above 1 and equal to or less than 6.

The above-mentioned L is preferably equal to or less than 30 mm so as to prevent powder material (lubricant powder) sprayed from the material spray port for upper punch h5 of the powder material application part for upper punch from scattering on the area which isn't required to be applied with powder material.

The width W of the powder material spray port for upper punch of the powder material application part for upper punch is preferably equal to or less than 1.5 times the diameter of the upper punch 15.

The width W for producing oral administration tablets is equal to or more than 0.1 mm and equal to or less than 5 mm, more preferably equal to or more than 1 mm and equal to or less than 3 mm.

(Embodiment of Invention 2)

Figure 10:
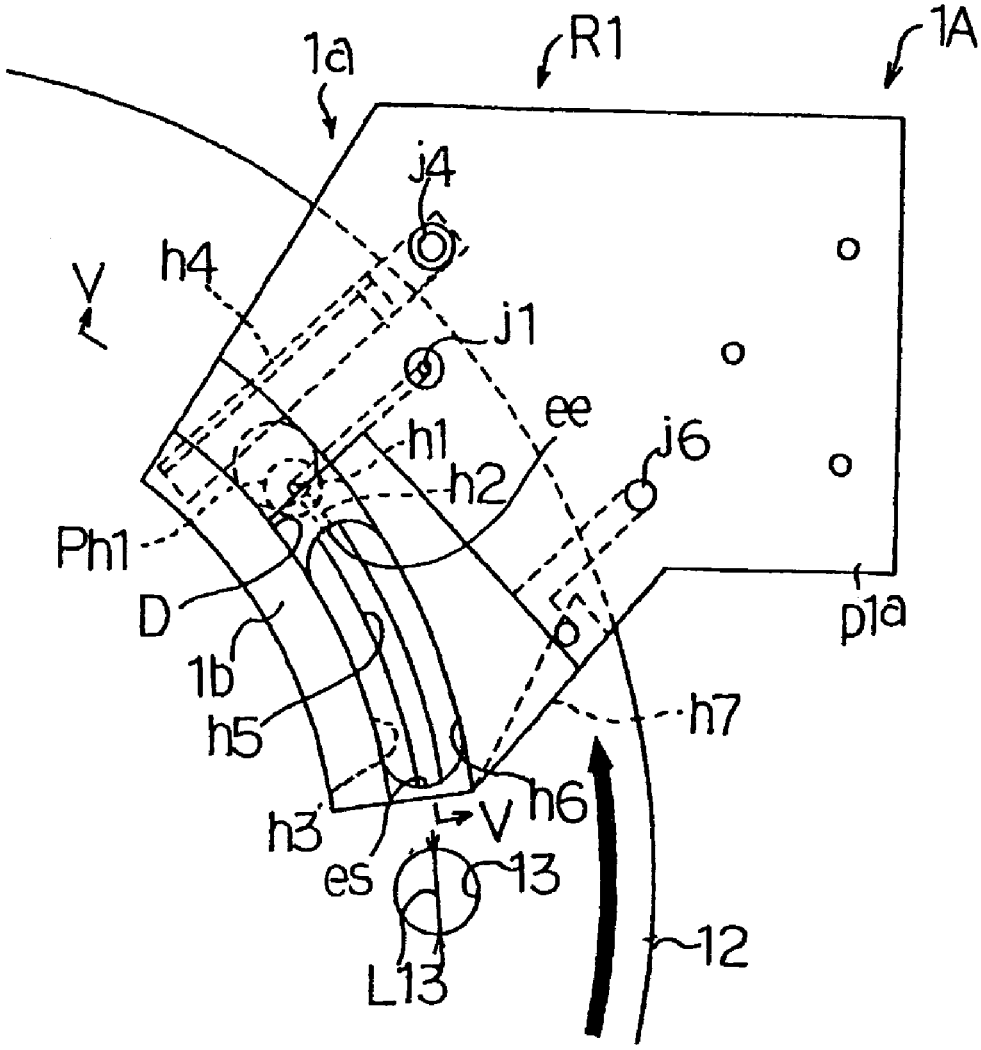
FIG. 10 is a plan view diagrammatically showing other embodiment of a powder material application apparatus of the present invention.

FIG. 10 is a plan view diagrammatically showing other embodiment of a powder material application apparatus (lubricant spray means) of the present invention.

Figure 11:
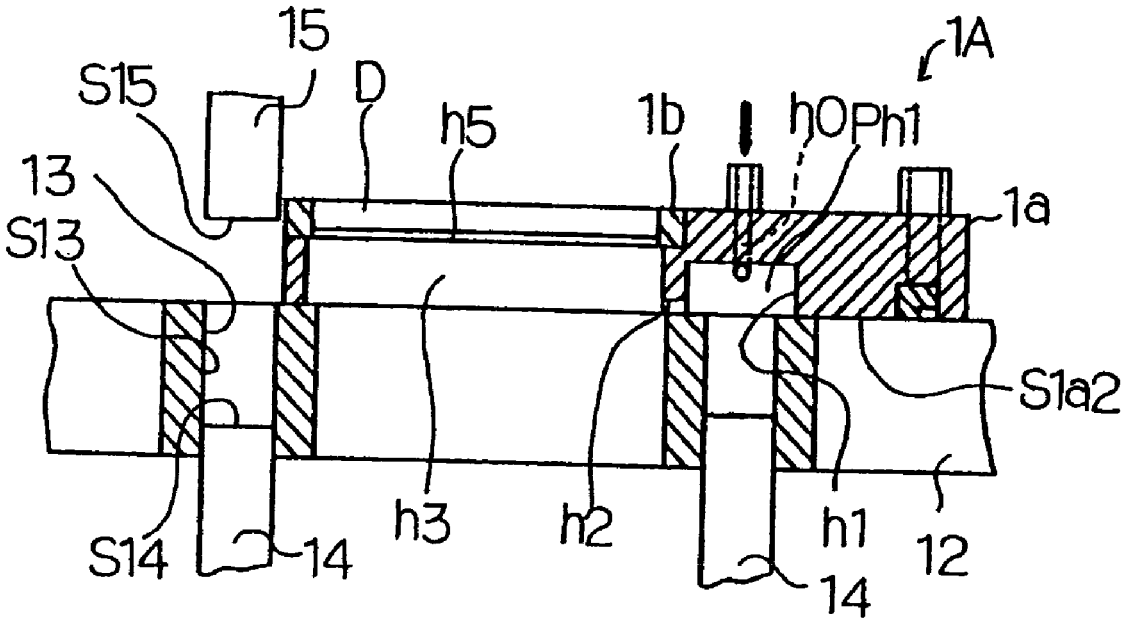
FIG. 11 is a diagrammatic sectional view of the powder material application apparatus (lubricant spray means) of the present invention shown in FIG. 10.

FIG. 11 is a diagrammatic sectional view of the powder material application apparatus (lubricant spray means) shown in FIG. 10.

The powder material application apparatus (lubricant spray means) 1A is the same as the powder material application apparatus (lubricant spray means) 1 explained in the Embodiment of Invention 1 except for the following constructions. Therefore, the parts of the powder material application apparatus (lubricant spray means) 1A corresponding to the powder material application apparatus (lubricant spray means) 1 have the same reference numerals and their explanations are omitted.

According to the powder material application apparatus (lubricant spray means) 1A, the pipe diameter of a powder material spray port for lower punch Ph1 is designed to be larger than that of a first communication passage h0.

The powder material (lubricant powder) mixed with air which is supplied from a powder material supply port j1 provided on the upper face of a powder material application part for lower punch 1*a* runs slowly in the powder material spray port (opening) for lower punch Ph1 comparing to when it runs in the first communication passage h0.

As a result, the flow speed of powder material (lubricant powder) sprayed from the powder material spray port (opening) for lower punch Ph1 becomes slow so that the powder material (lubricant powder) mixed with air and sprayed from the port Ph1 is easily applied on the material contacting surface (refer to the material contacting surface (upper surface) S15 of the lower punch 15 in FIG. 5) of the lower punch (refer to the upper punch 15 in FIG. 5).

Consequently, application of powder material (lubricant powder) can be effectively done on the material contacting surface (material contacting surface (upper surface) S15 of the lower punch 15 in FIG. 5) of the lower punch (lower punch 15 in FIG. 5) by means of the powder material application apparatus 1A.

In this embodiment, it is explained that the pipe diameter of the powder material spray port (opening) for lower punch Ph1 is made larger than that of the first communication passage h0. However, if the pipe diameter of the spray port Ph1 is made smaller than that of the passage h0, the flowing speed of powder material mixed with air becomes fast at the spray port Ph1.

Accordingly, if extra powder material is apt to be accumulated on the material contacting surface (material contacting surface (upper surface) S15 of the lower punch 15 in FIG. 5) of the lower punch (lower punch 15 in FIG. 5), it is effective to make the pipe diameter of the powder material spray port (opening) for lower punch Ph1 smaller than that of the first communication passage h0 for scattering the extra powder material (lubricant powder) on the surface S15 of the lower punch 15.

Thus the powder material application apparatus 1A has an effect that the application amount of powder material on the material contacting surface of the lower punch is easily controlled when the pipe diameter of the powder material spray port for lower punch is different from that of the first communication passage.

Namely, the powder material application apparatus 1A can easily and suitably control the application amount of lubricant powder on the material contacting surface of the lower punch.

(Embodiment of Invention 3)

Figure 12:
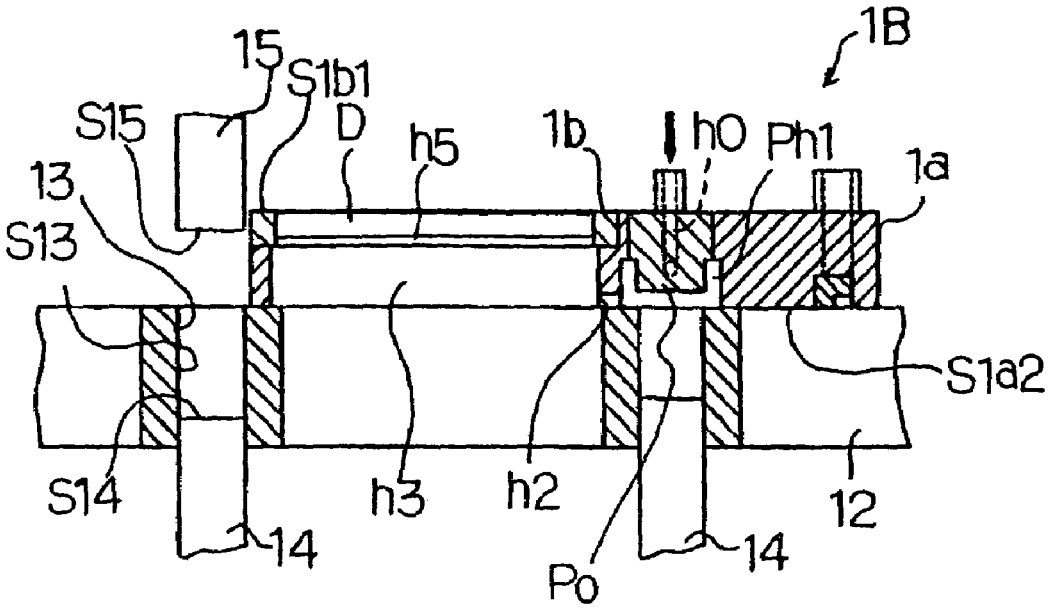
FIG. 12 is a sectional view diagrammatically showing other embodiment of a powder material application apparatus (lubricant spray means) of the present invention.

FIG. 12 is a sectional view diagrammatically showing other embodiment of a powder material application apparatus (lubricant spray means) of the present invention.

The powder material application apparatus (lubricant spray means) 1B is the same as the powder material application apparatus (lubricant spray means) 1 explained in the Embodiment of Invention 1 except for the following constructions. Therefore, the parts of the powder material application apparatus (lubricant spray means) 1B corresponding to the powder material application apparatus (lubricant spray means) 1 have the same reference numerals and their explanations are omitted.

According to the powder material application apparatus 1B, a cylindrical shielding pillar Po is provided so as to cover the center of the port Ph1, thereby forming the port Ph1 like a ring.

The powder material spray port (opening) Ph1 of the lower punch of the powder material application apparatus 1B is thus formed like a ring so that the flowing speed of powder material mixed with air and sprayed from the powder material spray port (opening) for lower punch Ph1 becomes slow at the area under the center of the powder material spray port (opening) for lower punch Ph1.

As a result, because of such a slow flow rate of powder material, the powder material (lubricant powder) sprayed from the powder material spray port for lower punch Ph1 and mixed with air is easily applied on the material contacting surface (material contacting surface (upper surface) S15 of the lower punch 15 in FIG. 5) of the lower punch (lower punch 15 in FIG. 5).

Hence, the powder material application apparatus 1B can effectively execute application of powder material on the material contacting surface (material contacting surface (upper surface) S15 of the lower punch 15 in FIG. 5) of the lower punch (lower punch 15 in FIG. 5).

The reduced sectional area of the ring-like spray port by enlarging the cylindrical shielding pillar Po can make the powder material (lubricant powder) mixed with air run faster at the powder material spray port (opening) for lower punch Ph1

Accordingly, if extra powder material is apt to be applied on the material contacting surface (material contacting surface (upper surface) S15 of the lower punch 15 in FIG. 5) of the lower punch (lower punch 15 in FIG. 5), it is effective to enlarge the cylindrical shielding pillar Po provided at the powder material spray port (opening) for lower punch Ph1 in order to scatter the extra powder thereon.

Thus, the powder material spray means 1B has a ring-like powder material spray port for lower punch so that the application amount of powder material on the material contacting surface of the lower punch can be easily controlled by changing the sectional area of the ring-like spray port.

Namely, the powder material application apparatus 1B can suitably control the application amount of lubricant powder on the material contacting surface of the lower punch.

Finally, a second communication passage h2 is explained.

The pipe diameter of the second communication passage h2 is preferably smaller than that of the powder material spray port (opening) for lower punch Ph1 and the sectional area of the hollow part h3 in either one of the powder material application apparatus 1A or 1B.

If the pipe diameter of the second communication passage for introducing powder material (lubricant powder) is made smaller than that of the powder material spray port (opening) for lower punch Ph1 and the sectional area of the hollow part h3, powder material mixed with air runs in the second communication passage h2 faster than in the powder material spray port (opening) for lower punch Ph1. As a result, the powder material (lubricant powder) mixed with air can be transferred from the first communication passage h2 to the hollow part h3 without being accumulated in the second communication passage h2.

In such a manner powder material (lubricant) doesn't incur waste in the powder material application apparatus 1A and 1B.

(Embodiment of Invention 4)

Figure 13:
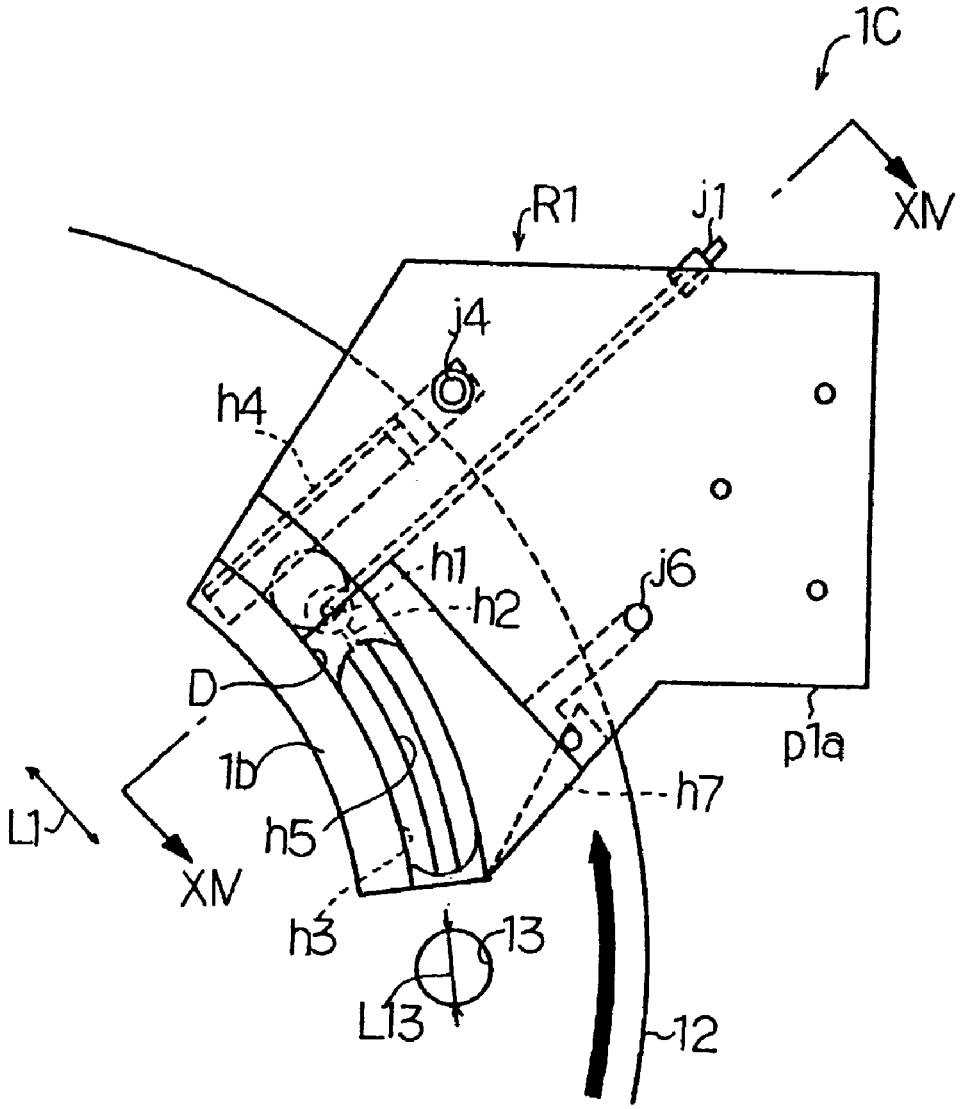
FIG. 13 is a plan view diagrammatically showing other embodiment of a powder material application apparatus (lubricant spray means) of the present invention.
Figure 14:
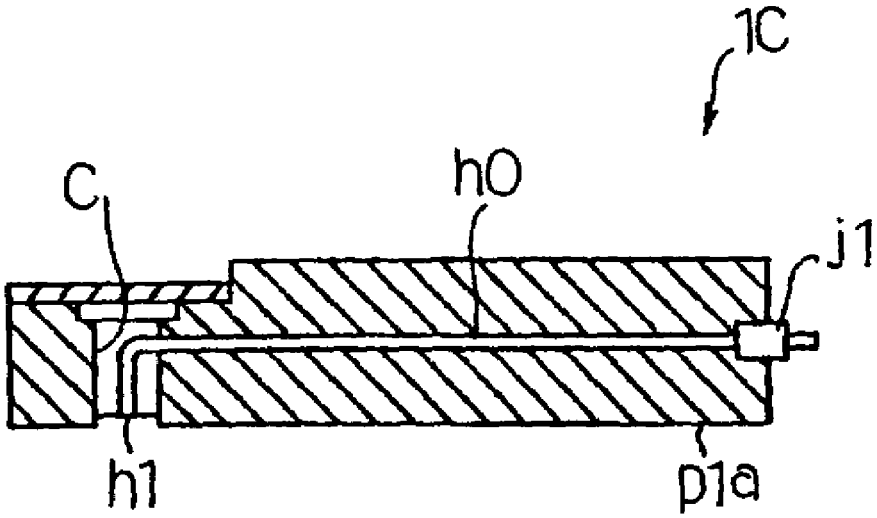
FIG. 14 is a diagrammatic sectional view along a line XIV—XIV in FIG. 13.

FIG. 13 is a plan view diagrammatically showing other embodiment of a powder material application apparatus (lubricant spray means) of the present invention. FIG. 14 is a diagrammatic sectional view along a line XIV—XIV in FIG. 13.

The powder material application apparatus (lubricant spray means) 1C is the same as the powder material application apparatus (lubricant spray means) 1 explained in the Embodiment of Invention 1 except for the following constructions. Therefore, the parts of the powder material application apparatus (lubricant spray means) 1C corresponding to the powder material application apparatus (lubricant spray means) 1 have the same reference numerals and their explanations are omitted.

In this powder material application apparatus 1C, connecting direction of a connection port j1 and a first communication passage h0 is substantially in liner, the connection port j1 being connected with a conduit (first communication passage h0) for supplying the powder material (lubricant powder in this embodiment) mixed with air to the powder material spray port for lower punch h1 of the powder material application part for lower punch 1*a*.

More specifically, the connecting direction of the connection port j1 and the first communication passage ho on the side face of a mounting plate p1*a* is liner.

Because of such connecting direction, the powder material spray means 1C can supply powder material to the spray port for lower punch h1 in more preferable dispersing condition.

Further, the connecting shape of the powder material spray port for lower punch h1 and the first communication passage ho is like an elbow in the powder material application apparatus IC.

More specifically, the pipe diameter of the area C (hollow part) of the powder material spray port for lower punch is larger than that of the first communication passage, the first passage h0 is folded under like a letter L so as to make it protrude into the area C, and the powder material spray port for lower punch h1 is provided in the center or around the center in the area C so as to direct downward.

The powder material spray port for lower punch h1 and the first communication passage h0 are connected in the form of elbow so that powder material mixed with air can be supplied into the powder material spray port for lower punch h1 without causing accumulation in the connection part.

INDUSTRIAL APPLICABILITY

As mentioned above, according to the powder material application apparatus of the present invention, the powder material spray port for upper punch is longer provided along the orbit of the plural upper punches comparing with the powder material spray port for lower punch of the powder material application part for lower punch so that plural upper punches on which material contacting surface powder material isn't easily applied by gravity are exposed to the powder material mixed with air sprayed from the powder material spray port for upper punch for a long time while each one of plural upper punches is moved from an initial end to the terminal end of the powder material spray port for upper punch.

As a result, required amount of powder material can be uniformly applied on each material contacting surface of plural upper punches on which powder material has not being applied enough because of gravity.

In addition, according to the powder material application apparatus, powder material sprayed from the powder material spray port for lower punch via the first communication passage is supplied into the powder material spray port for upper punch.

Thus, powder material which is apt to be accumulated on the material contacting surface of the lower punch on which powder material is easily applied by gravity can be blown off into the powder material spray port for upper punch.

If the powder material application apparatus uses lubricant powder as powder material, extra lubricant powder is blown out of the material contacting surface of the lower punch on which extra lubricant powder is easily applied by gravity. The blown out lubricant powder from the material contacting surface of the lower punch is applied on the material contacting surface of the upper punch on which lubricant powder is hardly applied by gravity. Thus the application amount of lubricant powder on the material contacting surface of the lower punch on which lubricant powder is easily applied by gravity and the application amount of lubricant powder on the material contacting surface of the upper punch on which lubricant powder is hardly applied by gravity can be the same or substantially same.

Therefore, when lubricant is sequentially applied on each material contacting surface of plural dies provided on the turntable of the rotary tabletting machine, each material contacting surface of plural lower punches inserted in a fixed position in each one of plural dies, and each material contacting surface of plural upper punches, lubricant powder is uniformly applied on each material contacting surface of dies, upper punches and lower punches. Then molding material is charged in the cavity formed by the die on which material contacting surface lubricant powder is applied and the lower punch which is inserted in the die and on which material contacting surface is applied with lubricant powder. The charged molding material is compressed with the lubricated die, the lubricated lower punch and the lubricated upper punch, thereby producing tablets without including lubricant without causing grinding of the punches and dies of the rotary type tabletting machine and without causing sticking, lamination, capping and so on.

According to the powder material application apparatus of the present invention, the powder material supply port and the first communication passage of the powder material application apparatus are connected in liner direction so that powder material can be supplied to the spray port for lower punch while being preferably dispersed.

According to the powder material application apparatus of the present invention, because of the difference of the pipe diameter of the powder material spray port for lower punch and that of the first communication passage, the application amount of powder material on the material contacting surface of the lower punch is easily controlled.

Therefore, using this powder material application apparatus, the application of lubricant material on the material contacting surface of the lower punch is easily controlled to be most suitable.

According to the powder material application apparatus of the present invention, the connected part of the powder material spray port for lower punch and the first communication passage is formed like an elbow, thereby supplying powder material mixed with air into the powder material spray port for lower punch without causing accumulation in the connected part.

According to the powder material application apparatus of the present invention, the powder material spray port for lower punch is designed to be detachable to the first communication passage so that the application amount of powder material on the material contacting surface of the lower punch can be easily controlled by optionally changing the shape of the powder material spray port for lower punch.

According to the powder material application apparatus of the present invention, the powder material spray port for lower punch is formed like a ring so that the application amount of powder material on the material contacting surface of the lower punch can be easily controlled by changing the sectional area of the ring-like spray port.

Therefore, according to the powder material application apparatus, the amount of lubricant powder is easily controlled to be suitably applied on the material contacting surface of the lower punch.

According to the powder material application apparatus of the present invention, the pipe diameter of the second communication passage which introduces powder material from the powder material application part for lower punch to the powder material application part for upper punch is designed to be smaller than that of the powder material spray port for lower punch and the sectional area of the hollow part, therefore, powder material mixed with air flows in the second communication passage faster than in the powder material spray port for lower punch. As a result, powder material mixed with air is transferred to the hollow part from the first communication passage without causing accumulation in the second communication passage.

As a result, the powder material application apparatus doesn't incur waste.

According to the powder material application apparatus, the inside of the powder material spray port for lower punch is rendered with surface finishing with low friction resistance, thereby reducing the friction resistance caused by the powder material supplied from the first communication passage and the inside of the powder material spray port for lower punch. As a result, powder material is transferred without causing further accumulation and attachment so as not to incur waste of powder material.

According to the powder material application apparatus of the present invention, the powder material spray port for upper punch of the powder material application part for upper punch is formed longer in a direction along the rotary orbit of the upper punches and is formed shorter in a direction of the width orthogonal to the rotary orbit of the upper punches so that powder material sprayed together with air from the powder material spray port for upper punch is hardly scattered in the area other than the material contacting surface of the upper punch.

Therefore, applying this powder material application apparatus, the members of the rotary type tabletting machine which should not be applied with powder material aren't polluted by the material.

In addition, tablets without including lubricant powder can be effectively produced by the powder material spray means.

According to the powder material application apparatus of the present invention, the powder material spray port for upper punch of the powder material application apparatus is constructed such that plural slit apertures, each provided in orthogonal direction to the rotary orbit of plural upper punches are aligned along the rotary orbit of the upper punch.

Therefore, powder material mixed with air which is sprayed from each one of slit apertures provided in orthogonal direction to the rotary orbit of the upper punches is rectified by the slit apertures to flow upward from the powder material spray port for upper punch. Accordingly powder material mixed with air and supplied from each slit aperture collides with the material contacting surface of the upper punch in substantially orthogonal direction.

As a result, powder material is surely applied on the material contacting surface of the upper punch on which powder material is hardly applied by gravity.

According to the powder material application apparatus of the present invention, the distance between the upper surface of the powder material application part for upper punch and the material contacting surface of the upper punches passing above the upper surface upon driving the rotary type tabletting machine and the width of the material spray port for upper punch of the powder material application part for upper punch are defined so as to prevent powder material mixed with air and sprayed from the powder material spray port for upper punch from scattering to the area other than the material contacting surface of the upper punch.

Therefore, according to this powder material spray means, the members of the rotary type tabletting machine on which powder material should not be applied don't become dirty.

If the powder material spray means uses lubricant powder as powder material, tablets without including lubricant powder can be effectively produced.

According to the powder material application apparatus of the present invention, the air suction means with the air suction port entirely covering the powder material spray port for upper punch is provided above the powder material spray port for upper punch.

Thus, when the air suction means is driven, extra powder material which has been sprayed from the powder material spray port for upper punch and not applied on the material contacting surface of the upper punch is suck to be removed from the air suction port. Therefore, the members of the rotary type tabletting machine which should not be applied with powder material aren't polluted by powder material.

As a result, if the powder material application apparatus uses lubricant powder as powder material, tablets without including lubricant powder can be effectively produced.

According to the powder material application apparatus of the present invention, the suction port for lower punch is further provided at the lower part of the powder material application part for lower punch and still further the air suction means is provided, thereby removing extra powder material attached on the lower punch, the die and the turntable. Therefore, such extra powder material is prevented from being mixed with molding material. As a result tablets without including lubricant powder can be effectively produced when the powder material application apparatus uses lubricant powder as powder material.

According to the powder material application apparatus of the present invention, lubricant powder mixed with air is sequentially applied on each material contacting surface of plural dies provided on the turntable of the rotary tabletting machine, each material contacting surface of plural upper punches inserted in a fixed position in each die and each material contacting surface of plural upper punches so that lubricant powder is surely applied on the material contacting surface of the upper punch on which lubricant powder isn't easily applied by gravity.

In addition, powder material sprayed from the powder material spray port for lower punch through the first communication passage of the powder material application apparatus is supplied into the powder material spray port for upper punch.

Therefore, extra powder material which is apt to be accumulated on the material contacting surface of the lower punch on which material is easily attached by gravity is blown off to the powder material spray port for upper punch.

As a result, extra lubricant powder is blown out of the material contacting surface of the lower punch on which material is apt to be accumulated by gravity, and the blown lubricant powder is applied on the material contacting surface of the upper punch on which lubricant powder is hardly applied by gravity. Thus the application amount of lubricant powder on the material contacting surface of the lower punch which is easily applied with lubricant powder and that on the material contacting surface of the upper punch which is hardly applied with lubricant powder become the same or substantially same.

Therefore, when lubricant is sequentially applied on each material contacting surface of plural dies provided on the turntable of the rotary type tabletting machine, each material contacting surface of plural lower punches inserted in a fixed position in each one of plural dies, and each material contacting surface of plural upper punches, lubricant powder is uniformly applied on each material contacting surface of dies, upper punches and lower punches. Then at a molding material charge position of the rotary type tabletting machine, molding material is charged in the cavity formed by the die on which material contacting surface lubricant powder is applied and the lower punch which is inserted in the die and on which material contacting surface is applied with lubricant powder. At a compression position, the charged molding material is compressed with the lubricated die, the lubricated lower punch and the lubricated upper punch, thereby producing tablets without including lubricant, without causing grinding of the punches and dies of the rotary type tabletting machine and without causing sticking, lamination, capping and so on.

According to the tablet production method of the present invention, powder material is applied on the material contacting surfaces of the dies, the lower punches and the upper punches of the rotary type tabletting machine, thereby preventing grinding of the dies, the lower punches and the upper punches when molding material is compressed by means of the dies, the lower punches and the upper punches on which material contacting surfaces are applied with powder material. In addition, tabletting problems such as sticking aren't caused on produced tablets.

The invention claimed is:

1. A rotary type-tabletting machine in which powder material is sequentially applied onto molding material contacting surfaces of dies provided on a turntable, upper punches and lower punches, and said upper punches and lower punches reciprocate up and down for tabletting while rotating along a rotary orbit in synchronism with rotary movement of said turntable, comprising:

a powder material application apparatus mounted on upper surface of said turntable between a tablet discharge position and a molding material charging position of said rotary type tabletting machine, said powder material application apparatus comprising:

a powder material spray opening for lower punch communicating with a powder material supply port for supplying powder material mixed with air via a first communication passage, and a powder material spray opening for upper punch communicating with said powder material supply port via a second communication passage, said powder material spray opening for upper punch being of elongated shape along the rotary orbit of said upper punches and longer than said powder material spray opening for lower punch, wherein said powder material spray opening for lower punch and powder material spray opening for upper punch are different in their structure, and wherein said powder material sprayed from said powder material spray opening for upper punch is applied upward onto said molding material contacting surface of said upper punch when said upper punch passes above said powder material spray opening for upper punch, whereas powder material sprayed from said powder material spray opening for lower punch is applied downward onto said molding material contacting surfaces of said lower punch and said die when said lower punch and said die reach said powder material spray opening for lower punch.

2. The rotary type-tabletting machine as set forth in claim 1, wherein said powder material spray opening for lower punch interconnects with said powder material spray opening for upper punch via said second communication passage and wherein said powder material supply port communicates with said powder material spray opening for lower punch via said first communication passage.

3. The rotary type-tabletting machine as set forth in claim 1 or 2, wherein said powder material spray opening for lower punch has a ring shape.

4. The rotary type-tabletting machine as set forth in claim 1 or 2, wherein the inside diameter of said second communication passage is smaller than that of said powder material spray opening for lower punch.

5. The rotary type-tabletting machine as set forth in claim 1 or 2, wherein said powder material spray opening for upper punch is exchangeable.

6. The rotary type-tabletting machine as set forth in claim 1 or 2, wherein said powder material spray opening for upper punch is a slit whose length is larger than its width.

7. The powder material application apparatus as set forth in claim 6, wherein said powder material spray opening for upper punch is composed of plural slit apertures arranged along the rotary orbit of said upper punches.

8. The rotary type-tabletting machine as set forth in claim 1 or 2, further comprising an air suction port for upper punch provided so as to entirely cover said powder material spray opening for upper punch and air suction means connected to said suction port for upper punch, wherein said suction port for upper punch is provided above said material contacting surface of said upper punch along the rotary orbit of said upper punch.

9. The rotary type-tabletting machine as set forth in claim 1 or 2, further comprising an air suction port for lower punch for removing extra powder material from surfaces of said die and said lower punch and/or said turntable, and an air suction means connected to said air suction port for lower punch, and wherein said air suction port for lower punch is provided downstream of rotary orbit of said turntable from said powder material spray opening for lower punch.

10. The rotary type-tabletting machine as set forth in claim 1 or 2, further comprising a suction recess and extra powder suction means connected to said suction recess for removing residual molding material from the surface of said turntable and/or said die and lower punch, wherein said suction recess is provided upstream of the rotary orbit of said turntable from said powder material spray opening for lower punch.

11. The rotary type-tabletting machine as set forth in claim 1 or 2, wherein said powder material spray port supplies lubricant powder.

12. The rotary type-tabletting machine as set forth in claim 11, further comprising an air suction means having an air suction port for upper punch, wherein said air suction port is provided above said powder material spray opening for upper punch so as to entirely cover said powder material spray opening for upper punch.

13. The rotary type-tabletting machine as set forth in claim 12, further comprising a suction means having an air suction port for lower punch, wherein said air suction port for lower punch is provided in forward direction of rotation of said turntable and apart from said material spray opening for lower punch so as not to communicate with said powder material spray opening for lower punch through said die when said die reaches said material spray opening for lower punch according to the rotation of said turntable.

* * * * *